US011752762B2

(12) United States Patent
Murayama et al.

(10) Patent No.: US 11,752,762 B2
(45) Date of Patent: Sep. 12, 2023

(54) LIQUID DISCHARGE METHOD, NON-TRANSITORY COMPUTER-READABLE STORAGE MEDIUM STORING DRIVE PULSE DETERMINATION PROGRAM, AND LIQUID DISCHARGE APPARATUS

(71) Applicant: SEIKO EPSON CORPORATION, Tokyo (JP)

(72) Inventors: Toshiro Murayama, Fujimi-machi (JP); Takahiro Katakura, Okaya (JP); Nobuaki Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 66 days.

(21) Appl. No.: 17/154,735

(22) Filed: Jan. 21, 2021

(65) Prior Publication Data

US 2021/0229422 A1 Jul. 29, 2021

(30) Foreign Application Priority Data

Jan. 23, 2020 (JP) ..... 2020-009212

(51) Int. Cl.
*B41J 2/045* (2006.01)

(52) U.S. Cl.
CPC ..... *B41J 2/0457* (2013.01); *B41J 2/04561* (2013.01); *B41J 2/04581* (2013.01); *B41J 2/04588* (2013.01)

(58) Field of Classification Search
CPC ..... B41J 2/04581
See application file for complete search history.

(56) References Cited

U.S. PATENT DOCUMENTS 5,861,895 A 1/1999 Tajika et al.
6,485,133 B1 * 11/2002 Teramae ..... B41J 2/04588 347/68
2003/0146742 A1 * 8/2003 Nishida ..... B41J 2/04588 347/19
2004/0189732 A1 * 9/2004 Usuda ..... B41J 2/0456 347/19
2005/0104921 A1 * 5/2005 Watanabe ..... B41J 2/04588 347/19
2010/0073435 A1 * 3/2010 Miyazawa ..... B41J 2/04581 347/71

(Continued)

FOREIGN PATENT DOCUMENTS

JP H05-031905 2/1993

*Primary Examiner* — Shelby L Fidler
(74) *Attorney, Agent, or Firm* — WORKMAN NYDEGGER

(57) ABSTRACT

A liquid discharge method of discharging a liquid from a nozzle of a liquid discharge head by applying a drive pulse to a drive element of the liquid discharge head includes an acquisition step of acquiring a recording condition, and a driving step of applying the drive pulse to the drive element. The drive pulse includes a first potential, a second potential different from the first potential, and a third potential different from the first potential and the second potential. The second potential is to be applied after the first potential, and the third potential is to be applied after the second potential. In the liquid discharge method, in the driving step, the drive pulse in which a time of the third potential varies depending on the recording condition acquired in the acquisition step is applied to the drive element.

18 Claims, 27 Drawing Sheets

(56) References Cited

U.S. PATENT DOCUMENTS

| | | | | |
|---|---|---|---|---|
| 2010/0220134 | A1* | 9/2010 | Matsushita | B41J 2/04581 347/10 |
| 2012/0007906 | A1* | 1/2012 | Zhang | B41J 2/0459 347/14 |
| 2012/0249638 | A1* | 10/2012 | Takano | B41J 2/0459 347/10 |
| 2015/0015630 | A1* | 1/2015 | Ozawa | B41J 2/04581 347/10 |
| 2018/0001619 | A1* | 1/2018 | Fukuda | B41J 2/04573 |

* cited by examiner

FIG. 6

TA1

| No. | DISCHARGE CHARACTERISTIC ITEM | TARGET VALUE | ALLOWABLE RANGE |
|---|---|---|---|
| 1 | DRIVE FREQUENCY f0 | XX kHz | −YY TO +0 kHz |
| 2 | DISCHARGE AMOUNT VM | XX pL | ±YY pL |
| 3 | DISCHARGE RATE VC | XX m/s | ±YY m/s |
| 4 | DISCHARGE ANGLE $\theta$ | 0° | ±YY° |
| 5 | ASPECT RATIO AR OF DISCHARGE LIQUID SHAPE | XX | ±YY |
| ... | ... | ... | ... |

400

| DISCHARGE ANGLE θ | DRIVE PULSE P0 |
|---|---|
| ... | ... |
| θ1 |  |
| ... | ... |
| θ2<br>(θ2>θ1) |  |
| ... | ... |
| θ3<br>(θ3>θ2) |  |
| ... | ... |

400

| DISCHARGE ANGLE θ | DRIVE PULSE P0 |
|---|---|
| ... | ... |
| θ1 |  |
| ... | ... |
| θ2<br>(θ2>θ1) |  |
| ... | ... |

400

| DISCHARGE ANGLE θ | DRIVE PULSE P0 |
|---|---|
| ... | ... |
| θ1 |  |
| ... | ... |
| θ2<br>(θ2>θ1) |  |
| ... | ... |

400

| DISCHARGE ANGLE θ | DRIVE PULSE P0 |
|---|---|
| ... | ... |
| θ1 (θ1>θ2) |  |
| ... | ... |
| θ2 (θ2>θ3) |  |
| ... | ... |
| θ3 |  |
| ... | ... |

400

| DISCHARGE ANGLE θ | DRIVE PULSE P0 |
|---|---|
| ... | ... |
| θ1<br>(θ1 > θ2) |  |
| ... | ... |
| θ2 |  |
| ... | ... |

400

| DISCHARGE ANGLE θ | DRIVE PULSE P0 |
|---|---|
| ... | ... |
| θ1 (θ1 > θ2) |   |
| ... | ... |
| θ2 |   |
| ... | ... |

400

| THIRD POTENTIAL TIME T4 | DISCHARGE ANGLE θ | DRIVE PULSE P0 |
|---|---|---|
| T4(P2)=TT1 | ... | ... |
| | θ1 |  |
| | ... | ... |
| | θ2 (θ2>θ1) |  |
| | ... | ... |
| T4(P1)=TT2 (TT2>TT1) | ... | ... |
| | θ1 |  |
| | ... | ... |
| | θ2 (θ2>θ1) |  |
| | ... | ... |

400

| ASPECT RATIO AR | DRIVE PULSE P0 |
|---|---|
| ... | ... |
| AR1 |  |
| ... | ... |
| AR2<br>(AR2 > AR1) |  |
| ... | ... |

400

| ASPECT RATIO AR | DRIVE PULSE P0 |
|---|---|
| ... | ... |
| AR1<br>(AR1 > AR2) |  |
| ... | ... |
| AR2 |  |
| ... | ... |

400

| THIRD POTENTIAL TIME T4 | ASPECT RATIO AR | DRIVE PULSE P0 |
|---|---|---|
| T4(P2)=TT1 | ... | ... |
| | AR1 |  |
| | ... | ... |
| | AR2 (AR2>AR1) |  |
| | ... | ... |
| T4(P1)=TT2 (TT2>TT1) | ... | ... |
| | AR1 |  |
| | ... | ... |
| | AR2 (AR2>AR1) |  |
| | ... | ... |

FIG. 24

| FACTOR F0 | | VARIABLE VALUE 1 | VARIABLE VALUE 2 | VARIABLE VALUE 3 | VARIABLE VALUE 4 | VARIABLE VALUE 5 |
|---|---|---|---|---|---|---|
| F1 | d2 | 30 V | 35 V | 40 V | 45 V | 50 V |
| F2 | d1 | 5 V | 10V | 15 V | 20 V | 25 V |
| F3 | ΔE(s2) | ... | ... | ... | ... | ... |
| F4 | ΔE(s4) | ... | ... | ... | ... | ... |
| F5 | ΔE(s6) | ... | ... | ... | ... | ... |
| F6 | T2 | ... | ... | ... | ... | ... |
| F7 | T4 | ... | ... | ... | ... | ... |

| VARIABLE |
|---|
| a |
| b |
| c |
| d |
| e |
| f |
| g |

LIQUID DISCHARGE METHOD, NON-TRANSITORY COMPUTER-READABLE STORAGE MEDIUM STORING DRIVE PULSE DETERMINATION PROGRAM, AND LIQUID DISCHARGE APPARATUS

The present application is based on, and claims priority from JP Application Serial Number 2020-009212, filed Jan. 23, 2020, the disclosure of which is hereby incorporated by reference herein in its entirety.

BACKGROUND

1. Technical Field

The present disclosure relates to a liquid discharge method of discharging a liquid from a nozzle by applying drive pulse to drive element, a non-transitory computer-readable storage medium storing a drive pulse determination program, and a liquid discharge apparatus.

2. Related Art

A recording head that discharges an ink from a nozzle by applying a drive pulse to a drive element is known. JP-A-5-31905 discloses a recording method of applying a drive signal that has a rectangular wave shape and includes two pulse portions to a heat generating element of a recording head.

For example, when the drive element is a piezoelectric element, the rectangular wave-shaped drive pulse as disclosed in JP-A-5-31905 is not compatible with the drive element. In recent years, different recording conditions are required depending on various parameters such as a discharge amount of droplets from a nozzle, a discharge rate of droplets from the nozzle, and a coverage of dots. Thus, it is required to apply an appropriate drive pulse in accordance with the required recording condition, to the drive element.

SUMMARY

According to an aspect of the present disclosure, there is provided a liquid discharge method of using a liquid discharge head including a drive element and a nozzle to discharge a liquid from the nozzle by applying a drive pulse to the drive element. The liquid discharge method includes an acquisition step of acquiring a recording condition, and a driving step of applying the drive pulse to the drive element. The drive pulse includes a first potential, a second potential different from the first potential, and a third potential different from the first potential and the second potential, the second potential being to be applied after the first potential, and the third potential being to be applied after the second potential. In the driving step, the drive pulse in which a time of the third potential varies depending on the recording condition acquired in the acquisition step is applied to the drive element.

According to another aspect of the present disclosure, there is provided a non-transitory computer-readable storage medium storing a drive pulse determination program for determining a drive pulse to be applied to a drive element in a liquid discharge head including the drive element that discharges a liquid to a nozzle in accordance with the drive pulse. The program causes a computer to realize an acquisition function of acquiring a recording condition, and a determination function of determining the drive pulse. The drive pulse includes a first potential, a second potential different from the first potential, and a third potential different from the first potential and the second potential, the second potential being to be applied after the first potential, and the third potential being to be applied after the second potential. In the determination function, the drive pulse having a time of the third potential, that varies depending on the recording condition acquired by the acquisition function is determined.

According to still another aspect of the present disclosure, there is provided a liquid discharge apparatus that includes a liquid discharge head including a drive element and a nozzle and discharges a liquid from the nozzle by applying a drive pulse to the drive element. The liquid discharge apparatus includes an acquisition unit that acquires a recording condition, and a driving unit that applies the drive pulse to the drive element. The drive pulse includes a first potential, a second potential different from the first potential, and a third potential different from the first potential and the second potential, the second potential being to be applied after the first potential, and the third potential being to be applied after the second potential. The driving unit applies the drive pulse having a time of the third potential, that varies depending on the recording condition acquired by the acquisition unit, to the drive element.

BRIEF DESCRIPTION OF THE DRAWINGS

FIG. 6 is a schematic diagram illustrating an example of a target discharge characteristic table.

FIG. 24 is a schematic diagram illustrating an example of a plurality of factors in the drive pulse.

DESCRIPTION OF EXEMPLARY EMBODIMENTS

Figure 1:
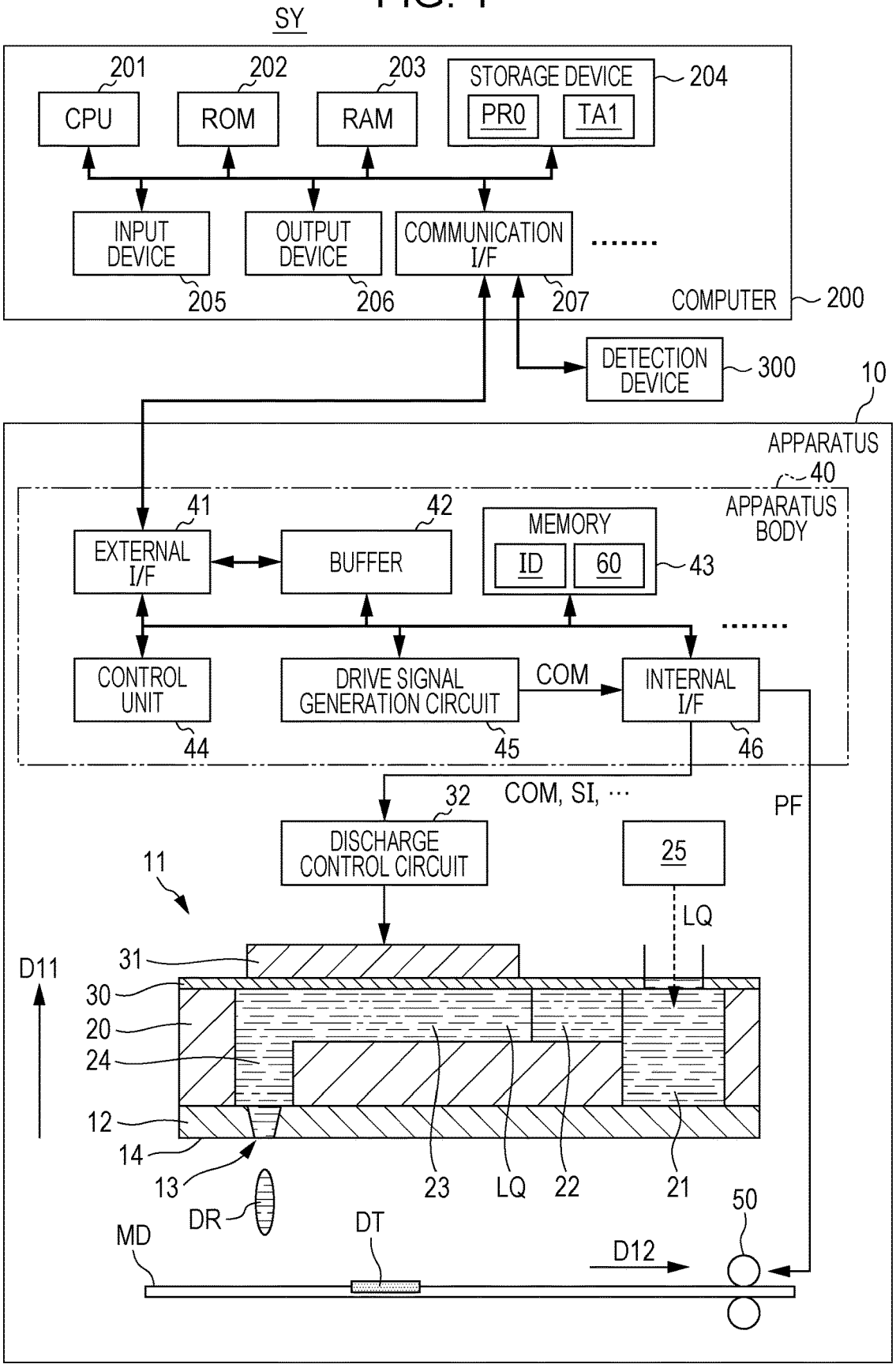
FIG. 1 is a schematic diagram illustrating a configuration example of a drive pulse generation system.

Hereinafter, embodiments of the present disclosure will be described. The following embodiments merely exemplify the present disclosure, and not all the features described in the embodiments are essential to the means for solving the disclosure.

(1) Outline of Technology Included in Present Disclosure

Firstly, an outline of a technology included in the present disclosure will be described. FIGS. 1 to 27 in the present application are schematic diagrams illustrating examples. The enlargement ratios in directions illustrated in FIGS. 1 to 27 may be different, and may not be consistent with each other. Elements in the present technology are not limited to those in specific examples, which are denoted by the reference numerals. In the "Outline of Technology Included in Present Disclosure", parentheses mean a supplementary explanation of the immediately preceding word.

According to an aspect of the present technology, a liquid discharge method uses a liquid discharge head 11 (for example, see FIG. 1) including a drive element 31 and a nozzle 13 to discharge a liquid LQ from the nozzle 13 by applying a drive pulse P0 (for example, see FIG. 3) to the drive element 31. The liquid discharge method includes an acquisition step ST1 (for example, Step S102 in FIG. 10) of acquiring a recording condition 400 and a driving step ST3 (for example, Step S106 in FIG. 10) of applying the drive pulse P0 to the drive element 31. Here, the drive pulse P0 includes a first potential E1, a second potential E2 different from the first potential E1, and a third potential E3 different from the first potential E1 and the second potential E2. The second potential E2 is to be applied after the first potential E1, and the third potential E3 is to be applied after the second potential E2. In the present method, in the driving step ST3, the drive pulse P0 having the first potential E1 that varies depending on the recording condition 400 acquired in the acquisition step ST1 is applied to the drive element 31.

In the above aspect, since the drive pulse P0 having the first potential E1 that varies depending on the recording condition 400 is applied to the drive element 31, various discharge characteristics are imparted to the liquid discharge head 11 that discharges the liquid LQ. Thus, in the above aspect, it is possible to provide a liquid discharge method capable of realizing various discharge characteristics. When the various discharge characteristics are imparted to the liquid discharge head 11, various characteristics are imparted to a dot DT formed on a recording medium MD by the liquid LQ discharged from the liquid discharge head 11.

The liquid discharge method may further include a determination step ST2 (for example, Step S104 in FIG. 10) of determining the drive pulse P0 to be applied in the driving step ST3, based on the recording condition 400. The liquid discharge method may further include a storing step ST4 (for example, Step S110 in FIG. 10) of storing waveform information 60 in a storage unit, in a state where the waveform information is associated with identification information ID of the liquid discharge head 11. The waveform information indicates the waveform of the one drive pulse P0 determined in the determination step ST2. Here, for example, the storage unit may be a memory 43 of an apparatus 10 including the liquid discharge head 11 illustrated in FIG. 1, a storage device 204 of a computer 200, or a storage device 254 of a server 250 illustrated in FIG. 29.

According to another aspect of the present technology, a drive pulse determination program PRO is provided for determining the drive pulse P0 applied to the drive element 31 in the liquid discharge head 11 including the drive element 31 that discharges the liquid LQ to the nozzle 13 in accordance with the drive pulse P0. The drive pulse determination program causes an acquisition function FU1 and a determination function FU2 to be realized on the computer 200. In the acquisition function FU1, the recording condition 400 is acquired. In the determination function FU2, the drive pulse P0 having the first potential E1 that varies depending on the recording condition 400 acquired by the acquisition function FU1 is determined.

In the above aspect, it is possible to provide a drive pulse determination program capable of realizing various discharge characteristics. The drive pulse determination program PRO may further cause an application control function FU3 corresponding to the driving step ST3 and a storing function FU4 corresponding to the storing step ST4 to be realized on the computer 200.

According to still another aspect of the present technology, a liquid discharge apparatus includes the liquid discharge head 11 including the drive element 31 and the nozzle 13 and discharges the liquid LQ from the nozzle 13 by applying the drive pulse P0 to the drive element 31. The liquid discharge apparatus includes an acquisition unit U1 and a driving unit U3. Here, the liquid discharge apparatus may be, for example, the apparatus 10 illustrated in FIG. 1 or a combined apparatus of the apparatus 10 and the computer 200. The acquisition unit U1 acquires the recording condition 400. The driving unit U3 applies the drive pulse P0 having the first potential E1 that varies depending on the recording condition 400 acquired by the acquisition unit U1, to the drive element 31.

In the above aspect, it is possible to provide a liquid discharge apparatus capable of realizing various discharge characteristics. The liquid discharge apparatus may further include a determination unit U2 corresponding to the determination step ST2 and a storage processing unit U4 corresponding to the storing step ST4.

Here, the recording condition means a condition when a liquid is discharged from the liquid discharge head. The recording condition includes a discharge characteristic of the liquid from the liquid discharge head and the state of a dot formed on a recording medium by the liquid discharged from the liquid discharge head.

The terms "first", "second", "third", and the like in the present application are terms for identifying each component in a plurality of components having similarities, and do not mean an order.

In the present application, a potential change rate is assumed to be represented by a positive value when the potential changes regardless of whether the change in potential is in a positive direction or a negative direction.

The present technology may be applied to a drive pulse determination method, a system including the liquid discharge apparatus, a control method of the system including the liquid discharge apparatus, a control program of the system including the liquid discharge apparatus, a computer readable medium in which any of the above-described programs is recorded, and the like. The liquid discharge apparatus may be configured by a plurality of distributed portions.

(2) Specific Example of Drive Pulse Generation System

Figure 2:
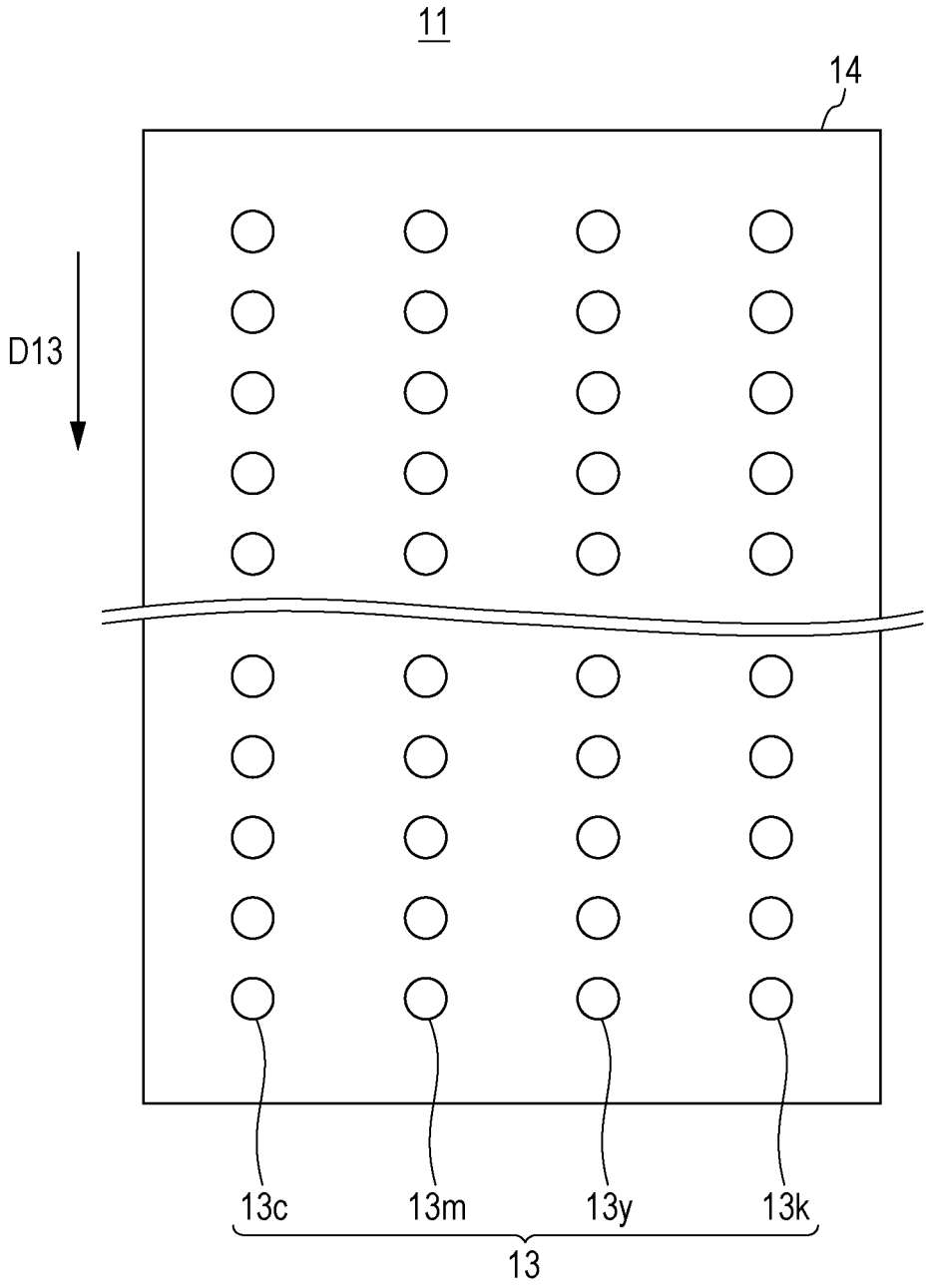
FIG. 2 is a schematic diagram illustrating an example of a nozzle surface of a liquid discharge head.

FIG. 1 schematically illustrates the configuration of a drive pulse generation system SY as a system example for implementing the liquid discharge method in the present technology. FIG. 2 schematically illustrates an example of a nozzle surface 14 of the liquid discharge head 11.

A drive pulse generation system SY illustrated in FIG. 1 includes an apparatus 10 including a liquid discharge head 11, a computer 200, and a detection device 300 that detects a drive result of the drive element 31.

The liquid discharge head 11 illustrated in FIG. 1 includes a nozzle plate 12, a flow path substrate 20, a diaphragm 30, and a plurality of drive elements 31 in order of a stacking direction D11. The structure of the liquid discharge head for implementing the present technology is not limited to the structure illustrated in FIG. 1. A structure in which the nozzle plate 12 and the flow path substrate 20 are integrally formed, a structure in which the flow path substrate 20 is divided into a plurality of pieces, a structure in which the flow path substrate 20 and the diaphragm 30 are integrally formed, and the like may be made. The liquid discharge head 11 further includes a discharge control circuit 32 that controls the discharge of the liquid LQ.

As illustrated in FIG. 2, the nozzle plate 12 includes a plurality of nozzles 13 and is bonded to the flow path substrate 20. Each nozzle 13 is a through hole that penetrates the nozzle plate 12 in the stacking direction D11. The liquid LQ is discharged as a droplet DR from the nozzle surface 14 on an opposite side of the flow path substrate 20 in the nozzle plate 12. When the droplet DR lands on the surface of a recording medium MD, the droplet DR changes to a dot DT. The nozzle surface 14 illustrated in FIG. 1 is a flat surface, but the nozzle surface is not limited to the flat surface. The nozzle plate 12 may be formed of, for example, metal such as stainless steel or a material such as single crystal silicon.

On the nozzle surface 14 illustrated in FIG. 2, a cyan nozzle row having a plurality of nozzles 13*c* for discharging cyan droplets, a magenta nozzle row having a plurality of nozzles 13*m* for discharging magenta droplets, a yellow nozzle row having a plurality of nozzles 13*y* for discharging yellow droplets, and a black nozzle row having a plurality of nozzles 13*k* for discharging black droplets are arranged. The plurality of nozzles 13*c*, the plurality of nozzles 13*m*, the plurality of nozzles 13*y*, and the plurality of nozzles 13*k* are arranged in a nozzle arrangement direction D13, respectively. The nozzle 13 is a general term for the nozzles 13*c*, 13*m*, 13*y*, and 13*k*. The nozzle arrangement direction D13 may coincide with a transport direction D12, or may be different from the transport direction D12. The plurality of nozzles in the nozzle row may be arranged in a staggered pattern. In addition, as the color of the droplets discharged from each nozzle included in the nozzle row, light cyan with a lower density than cyan, light magenta with a lower density than magenta, dark yellow with a higher density than yellow, and light black with a lower density than black, orange, green, transparency, and the like may be used. The present technology may also be applied to a liquid discharge head that does not discharge droplets of some colors of cyan, magenta, yellow, and black.

The flow path substrate 20 includes a common liquid room 21, a plurality of supply passages 22, a plurality of pressure chambers 23, and a plurality of communication passages 24, as flow paths, in order in which the liquid LQ flows, in a state where the flow path substrate is interposed between the nozzle plate 12 and the diaphragm 30. The combination of the supply passage 22, the pressure chamber 23, and the communication passage 24 serves as an individual flow path joined to each nozzle 13. Each of the communication passages 24 causes the pressure chamber 23 to communicate with the nozzle 13. The pressure chamber 23 illustrated in FIG. 1 is in contact with the diaphragm 30 and is separated from the nozzle plate 12. The liquid LQ is supplied from a liquid cartridge 25 to the common liquid room 21. The liquid LQ in the common liquid room 21 is divided into individual flow paths and supplied to the nozzles 13. The structure of the flow path is not limited to the structure illustrated in FIG. 1, and a structure in which the pressure chamber is in contact with the nozzle plate, and the like may be made. The flow path substrate 20 may be formed of, for example, a material such as a silicon substrate, metal, or ceramics.

The diaphragm 30 has elasticity and is bonded to the flow path substrate 20 to close the pressure chamber 23. The diaphragm 30 illustrated in FIG. 1 forms a portion of the wall surface of the pressure chamber. The diaphragm 30 may be formed of, for example, a material such as silicon oxide, metal oxide, ceramics, or synthetic resin.

Each drive element 31 is bonded to the diaphragm 30 at a position corresponding to the pressure chamber 23. It is assumed that the drive element 31 in the present specific example is a piezoelectric element that expands and contracts in accordance with a drive signal COM including a repeated drive pulse. For example, the piezoelectric element includes a piezoelectric body, a first electrode, and a second electrode. The piezoelectric element expands and contracts in accordance with a voltage applied between the first electrode and the second electrode. The drive element 31 illustrated in FIG. 1 is a layered piezoelectric element including a first electrode, a second electrode, and a piezoelectric layer between the first electrode and the second electrode. The plurality of drive elements 31 may have at least one type of the first electrode, the second electrode, and the piezoelectric layer. Thus, in the plurality of drive elements 31, the first electrode may be provided as a common electrode for joining between the drive elements, the second electrode may be provided as the common electrode for joining between the drive elements, or the piezoelectric layer may be provided for joining between the drive elements. The first electrode and the second electrode may be formed of a conductive material, for example, metal such as platinum or a conductive metal oxide such as indium tin oxide abbreviated as IT0. The piezoelectric material may be formed of, for example, a material having a perovskite structure, such as lead zirconate titanate abbreviated as PZT, and a lead-free perovskite-type oxide.

The drive element 31 is not limited to the piezoelectric element, and may be a heat generating element or the like that generates air bubbles in the pressure chamber by heat generation.

The discharge control circuit 32 controls the discharge of a droplet DR from each nozzle 13 by applying a voltage according to the drive signal COM to each drive element 31 at a discharge timing represented by a print signal SI. The discharge control circuit 32 does not supply the voltage according to the drive signal COM to the drive element 31 when it is not a timing to discharge the droplet DR. The discharge control circuit 32 may be formed by, for example, an integrated circuit such as a Chip On Film abbreviated as a COF.

The liquid LQ broadly includes inks, synthetic resins such as photocurable resins, liquid crystals, etching solutions, bioorganic substances, lubricating liquids, and the like. The ink widely includes a solution in which a dye or the like is dissolved in a solvent, a sol in which solid particles such as pigments or metal particles are dispersed in a dispersion medium, and the like.

The recording medium MD is made of a material that holds a plurality of dots formed by a plurality of droplets. Paper, synthetic resin, metal, and the like may be used for the recording medium. The shape of the recording medium may be a rectangle, a roll, a substantially circular shape, a polygon other than the rectangle, a three-dimensional shape, and the like and is not particularly limited.

The apparatus 10 including the liquid discharge head 11 includes an apparatus body 40 and a transport unit 50 that transports the recording medium MD.

The apparatus body 40 includes an external I/F 41, a buffer 42, the memory 43, a control unit 44, a drive signal generation circuit 45, an internal I/F 46, and the like. Here, the I/F is an abbreviation for an interface. The elements 41 to 46 and the like are electrically coupled to each other, and thus may input and output information to and from each other.

The external I/F 41 transmits and receives data to and from the computer 200. When the external I/F 41 receives print data from the computer 200, the external I/F 41 stores the print data in the buffer 42. The buffer 42 temporarily stores the received print data, or temporarily stores dot pattern data converted from the print data. For example, a semiconductor memory such as a random access memory abbreviated as a RAM may be used as the buffer 42. The memory 43 is non-volatile and stores the identification information ID of the liquid discharge head 11, the waveform information 60 indicating the waveform of the drive pulse, and the like. For example, a non-volatile semiconductor memory such as a flash memory may be used as the memory 43. The control unit 44 mainly performs data processing and control in the apparatus 10, for example, processing of converting print data into dot pattern data, processing of generating a print signal SI and a transport signal PF based on the dot pattern data, and the like. The print signal SI indicates whether or not to apply a drive pulse repeated in the drive signal COM to each drive element 31. The transport signal PF indicates whether or not to drive the transport unit 50. For example, a SoC and a circuit including a CPU, a ROM, and a RAM may be used for the control unit 44. Here, the SoC is an abbreviation for a System on a Chip. The CPU is an abbreviation for a Central Processing Unit, and a ROM is an abbreviation for a Read Only Memory. The drive signal generation circuit 45 generates the drive signal COM that repeats the drive pulse in accordance with the waveform information 60, and outputs the drive signal COM to the internal I/F 46. The internal I/F 46 outputs the drive signal COM, the print signal SI, and the like to the discharge control circuit 32 in the liquid discharge head 11, and outputs the transport signal PF to the transport unit 50.

The discharge control circuit 32 may be disposed in the apparatus body 40.

The transport unit 50 moves the recording medium MD in the transport direction D12 when the transport signal PF indicates driving. Moving of the recording medium MD may also be referred to as paper feeding.

The computer 200 includes a CPU 201 being a processor, a ROM 202 being a semiconductor memory, a RAM 203 being a semiconductor memory, a storage device 204, an input device 205, an output device 206, a communication I/F 207, and the like. The elements 201 to 207 and the like are electrically coupled to each other, and thus may input and output information to and from each other.

The storage device 204 stores information such as the drive pulse determination program PRO and a target discharge characteristic table TA1 described later. The CPU 201 appropriately reads the information stored in the storage device 204 onto the RAM 203, and performs a process of determining the drive pulse. As the storage device 204, a magnetic storage device such as a hard disk, a non-volatile semiconductor memory such as a flash memory, or the like may be used. As the input device 205, a pointing device, a hard key including a keyboard, a touch panel stuck to the surface of a display device, and the like may be used. As the output device 206, the display device such as a liquid crystal display panel, an audio output device, a printing device, or the like may be used. The communication I/F 207 is coupled to the external I/F 41 to transmit and receive data to and from the apparatus 10. The communication I/F 207 is coupled to the detection device 300 to transmit and receive data to and from the detection device 300.

The detection device 300 detects the drive result when the drive pulse is applied to the drive element 31. A camera, a video camera, a weighing scale, or the like may be used as the detection device 300.

Figure 3:
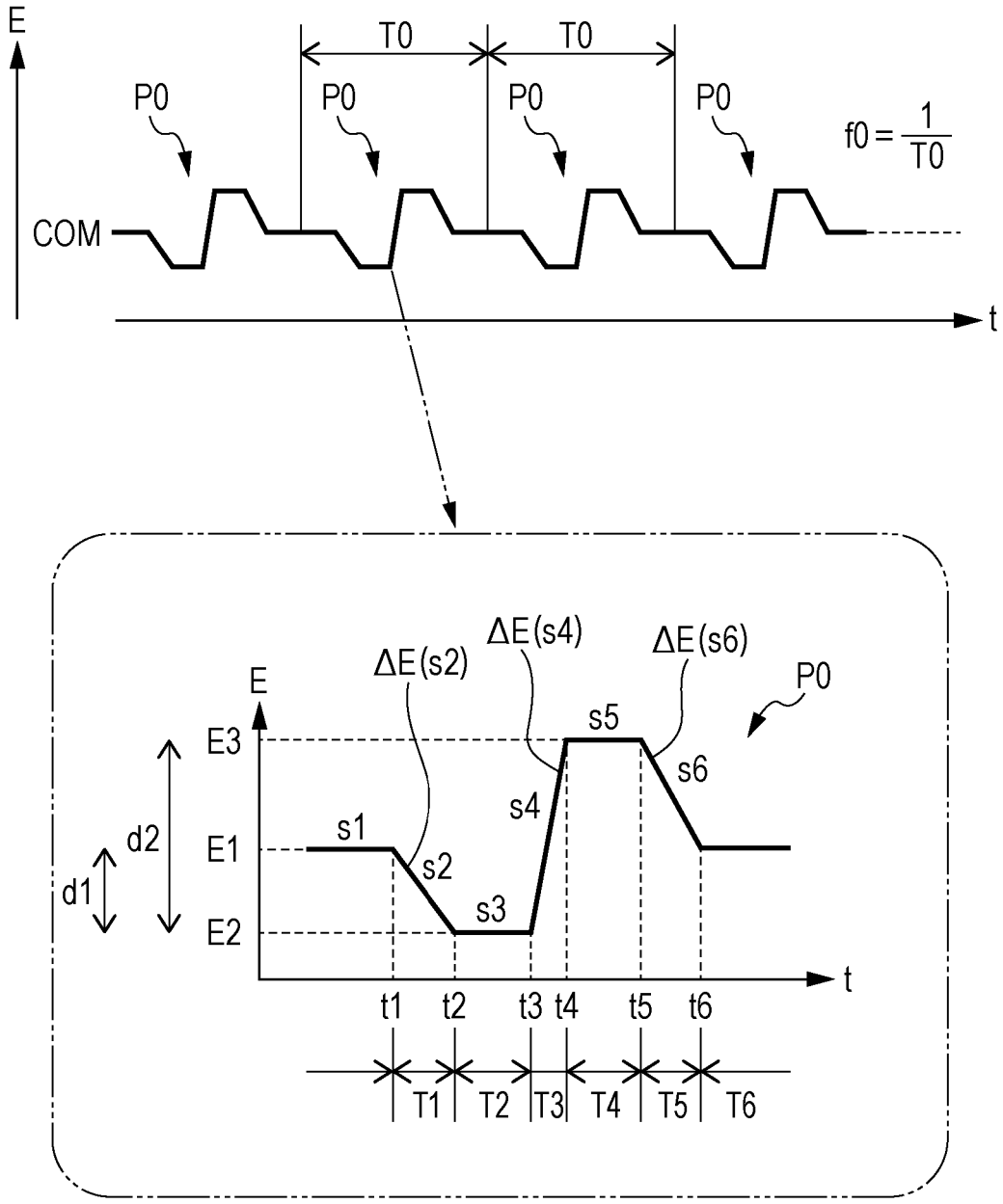
FIG. 3 is a schematic diagram illustrating an example of a change in potential of a drive signal including a repeated drive pulse.

FIG. 3 schematically illustrates an example of a change in potential of the drive signal including a repeated drive pulse. In FIG. 3, a horizontal axis indicates the time t, and a vertical axis indicates the potential E. An example of a change in the potential of a drive pulse P0 in the drive signal COM is schematically illustrated at the lower portion of FIG. 3.

As illustrated in FIG. 3, the drive signal COM includes the drive pulse P0 repeated in a period T0. The drive pulse P0 means a unit of a change in the potential that drives the drive element 31 such that a droplet DR is discharged from the nozzle 13. The frequency of the drive pulse P0, that is, a drive frequency f0 of the drive element 31 is 1/T0.

The potential E of the drive pulse P0 illustrated at the lower portion of FIG. 3 includes a state s1 of a first potential E1, a state s2 of changing from the first potential E1 to a second potential E2, a state s3 of the second potential E2, a state s4 of changing from the second potential E2 to a third potential E3, a state s5 of the third potential E3, and a state s6 of returning to the first potential E1 from the state s5 of the third potential E3. Thus, the drive pulse P0 includes the first potential E1, the second potential E2 different from the first potential E1, and the third potential E3 different from the first potential E1 and the second potential E2, in this order. That is, the second potential E2 is a potential to be applied to the drive element 31 after the first potential E1. The third potential E3 is a potential to be applied to the drive element 31 after the first potential E1 and the second potential E2. The first potential E1 is a potential between the second potential E2 and the third potential E3. The second potential E2 illustrated in FIG. 3 is lower than the first potential E1. The third potential E3 illustrated in FIG. 3 is higher than the first potential E1 and the second potential E2. The period T0 of one cycle includes a timing t1 between the states s1 and s2, a timing t2 between the states s2 and s3, a timing t3 between the states s3 and s4, a timing t4 between the states s4 and s5, a timing t5 between the states s5 and s6, and a timing t6 at which the state s6 is ended. The period T0 of one cycle includes a time T1 from the timing t1 to the timing t2, a time T2 from the timing t2 to the timing t3, a time T3 from the timing t3 to the timing t4, a time T4 from the timing t4 to the timing t5, and a time T5 from the timing t5 to the timing t6. That is, the times T1 to T5 are times when the potential E is in the states s2 to s6, respectively. Assuming that a time from the timing t6 to the timing t1 of the next drive pulse P0 is T6, the period T0 is the sum of the times T1 to T6.

Here, a difference between the first potential E1 and the second potential E2 is set to d1, and a difference between the second potential E2 and the third potential E3 is set to d2. The differences d1 and d2 are set to be represented by positive values as shown in the expressions as follows.

$$d1=|E1-E2|$$

$$d2=|E3-E2|$$

The change rates of the potential E in the states s2, s4, and s6 in which the potential E changes are defined as ΔE(s2), ΔE(s4), and ΔE(s6), respectively. The potential change rates ΔE(s2), ΔE(s4), and ΔE(s6) are set to be represented by positive values by setting a case where the potential E does not change to 0, as shown in the expressions as follows.

$$\Delta E(s2)=|E1-E2|/T1$$

$$\Delta E(s4)=|E3-E2|/T3$$

$$\Delta E(s6)=|E3-E1|/T5$$

That is, the potential change rate ΔE(s2) increases as the difference d1 becomes greater. The potential change rate ΔE(s4) increases as the difference d2 becomes greater. The potential change rate ΔE(s6) increases as a difference between the third potential E3 and the first potential E1 becomes greater.

Description will be made below using the states s1 to s6, the timings t1 to t6, the times T1 to T6, the differences d1 and d2, and the potential change rates ΔE(s2), ΔE(s4), and ΔE(s6).

Figure 4:
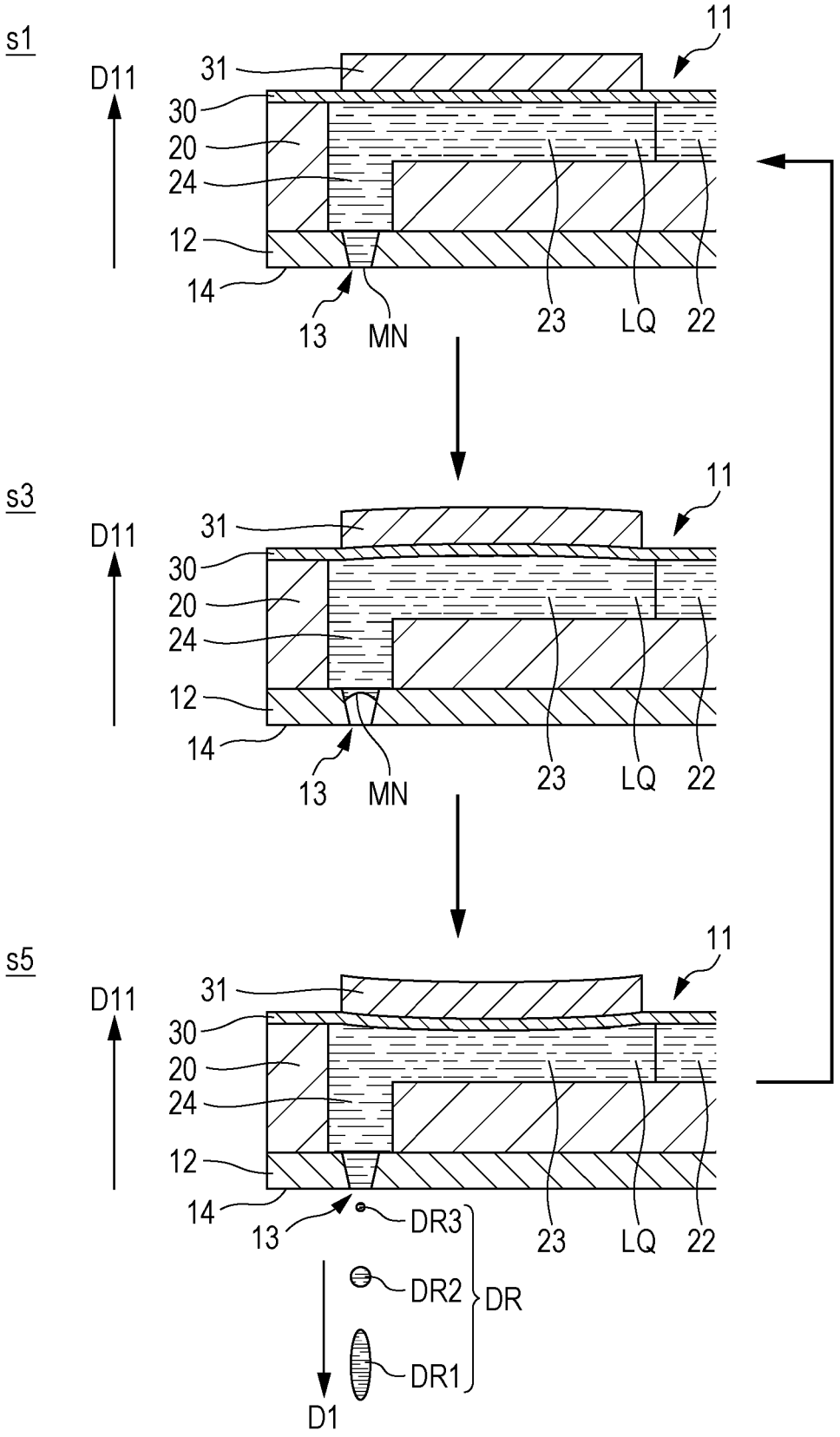
FIG. 4 is a schematic diagram illustrating an operation example of the liquid discharge head.

FIG. 4 schematically illustrates an operation example of the liquid discharge head 11 that discharges the droplet DR in accordance with the drive signal COM.

A form of the liquid discharge head 11 at a certain moment in the state s1 in which the drive pulse P0 is maintained at the first potential E1 is illustrated at the upper portion of FIG. 4. When the potential E of the drive pulse P0 is constant, the operation of the drive element 31 is stopped. When the drive pulse P0 changes from the first potential E1 to the second potential E2, the drive element 31 to which the drive pulse P0 is applied is deformed such that the pressure chamber 23 expands. When the pressure chamber 23 expands, the meniscus MN of the liquid LQ is drawn from the nozzle surface 14 toward the back, and the liquid LQ is supplied from the supply passage 22 to the pressure chamber 23. A form of the liquid discharge head 11 at a certain moment in the state s3 in which the drive pulse P0 is maintained at the second potential E2 is illustrated at the middle portion of FIG. 4.

When the drive pulse P0 changes from the second potential E2 to the third potential E3, the drive element 31 to which the drive pulse P0 is applied is deformed such that the pressure chamber 23 contracts. When the pressure chamber 23 contracts, the droplet DR is discharged from the nozzle 13. A form of the liquid discharge head 11 at a certain moment in the state s5 in which the drive pulse P0 is maintained at the third potential E3 is illustrated at the lower portion of FIG. 4. A discharge direction D1 of the droplet DR is a direction away from the nozzle surface 14, but is not limited to a direction perpendicular to the nozzle surface 14. The droplet DR may be divided into a main droplet DR1 and a satellite DR2 smaller than the main droplet DR1, and may include a grandchild satellite DR3 smaller than the satellite DR2. The grandchild satellite DR3 may not land on the recording medium MD and may adhere to the nozzle surface 14 near the nozzle 13. The grandchild satellite DR3 adhering to the nozzle surface 14 may affect the discharge direction D1 of the subsequent droplet DR.

When the drive pulse P0 returns from the third potential E3 to the first potential E1, the drive element 31 to which the drive pulse P0 is applied is deformed such that the pressure chamber 23 expands to the original size of the pressure chamber. When the pressure chamber 23 expands to the original size of the pressure chamber, the liquid LQ is supplied from the supply passage 22 to the pressure chamber 23. Thus, the liquid discharge head 11 returns from the state illustrated at the lower portion of FIG. 4 to the state illustrated at the upper portion of FIG. 4.

The drive pulse P0 is not limited to the waveform illustrated in FIG. 3 so long as the droplet DR may be enabled to be discharged from the nozzle 13. For example, when the drive element 31 with respect to the potential E of the drive pulse P0 moves in the opposite direction to the examples illustrated in FIGS. 3 and 4, the drive pulse P0 illustrated in FIG. 5A may be applied to the drive element 31. For example, a structure in which the stacking of the diaphragm 30 and the drive element 31 is reversely performed may be made. The drive pulse P0 illustrated in FIG. 5B may be applied to the drive element 31.

Figure 5A:
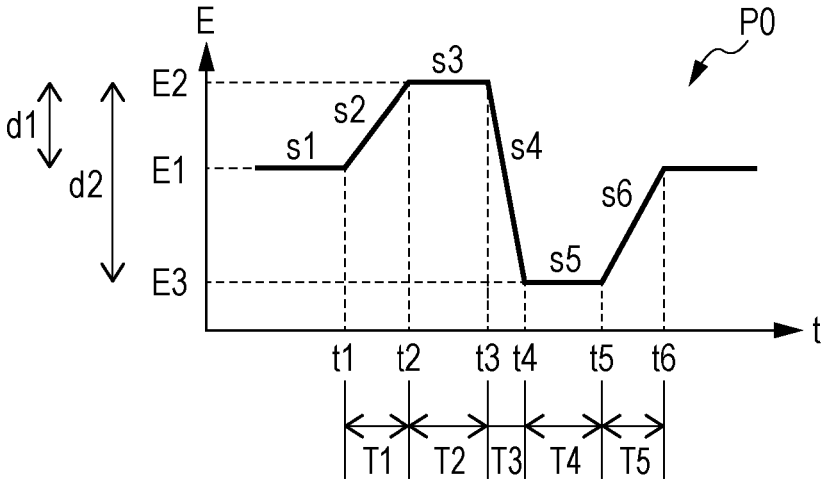
FIGS. 5A and 5B are schematic diagrams illustrating an example of the change in potential of the drive signal including a repeated drive pulse.

The first potential E1 of the drive pulse P0 illustrated in FIG. 5A is also a potential between the second potential E2 and the third potential E3. However, the second potential E2 illustrated in FIG. 5A is higher than the first potential E1.

The third potential E3 illustrated in FIG. 5A is lower than the first potential E1 and the second potential E2. The operation of the liquid discharge head 11 illustrated in FIG. 4 is also realized by the drive pulse P0 illustrated in FIG. 5A.

Figure 5B:
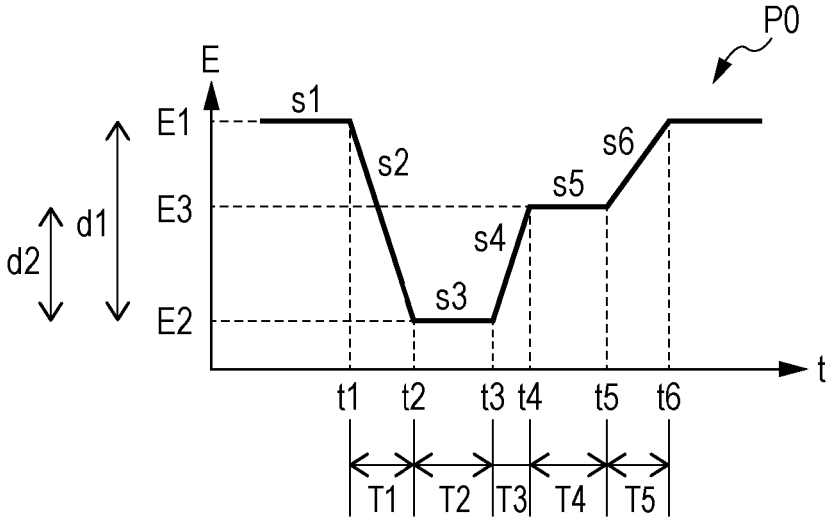

The second potential E2 of the drive pulse P0 illustrated in FIG. 5B is lower than the first potential E1. The third potential E3 illustrated in FIG. 5B is lower than the first potential E1 and higher than the second potential E2. Even in a case of the drive pulse P0 illustrated in FIG. 5B, the drive pulse P0 changes from the second potential E2 to the third potential E3, and thereby the drive element 31 is deformed such that the pressure chamber 23 contracts. Thus, the droplet DR is discharged from the nozzle 13.

The drive pulse P0 may be made to have various waveforms such as a waveform obtained by turning the waveform illustrated in FIG. 5B upside down. Any waveform may be represented by a parameter group including the states s1 to s6, the timings t1 to t6, the times T1 to T6, the differences d1 and d2, and the potential change rates ΔE(s2), ΔE(s4), and ΔE(s6).

When each of the states s1 to s6 of the drive pulse P0 changes, the discharge characteristic of the liquid LQ from the liquid discharge head 11 changes. When the drive pulse P0 having a waveform that varies depending on the discharge characteristic is applied to the drive element 31, it is possible to impart various discharge characteristics in accordance with the discharge characteristic of the liquid LQ, to the liquid discharge head 11 that discharges the liquid LQ.

The state of the dot DT formed on the recording medium MD by the liquid LQ discharged from the liquid discharge head 11 differs depending on the type of the recording medium MD, the properties of the liquid LQ, and the like. Here, it is assumed that the state of the dot DT formed on the recording medium MD by the liquid LQ discharged from the liquid discharge head 11 is referred to as an on-paper characteristic. When the drive pulse P0 having a waveform that varies depending on the on-paper characteristic is applied to the drive element 31, it is possible to impart various discharge characteristics in accordance with the on-paper characteristic, to the liquid discharge head 11 that discharges the liquid LQ.

In the present specific example, the drive pulse P0 having a waveform that varies depending on the recording condition including the discharge characteristic and the on-paper characteristic is applied to the drive element 31, and thereby various discharge characteristics in accordance with the recording condition are imparted to the liquid discharge head 11 that discharges the liquid LQ. The discharge characteristic and the on-paper characteristic will be described below.

(3) Specific Example of Discharge Characteristic

FIG. 6 schematically illustrates an example of the target discharge characteristic table TA1. For example, the target discharge characteristic table TA1 is stored in the storage device 204 of the computer 200 illustrated in FIG. 1, and is used to determine the waveform of the drive pulse P0. A target value and an allowable range for each of a plurality of discharge characteristic items such as a drive frequency f0, a discharge amount VM, a discharge rate VC, a discharge angle θ, and an aspect ratio AR are stored in the target discharge characteristic table TA1. For convenience of the description, identification numbers from No. 1 are assigned to the discharge characteristic items, respectively. As illustrated in FIG. 6, the discharge characteristics include the drive frequency f0, the discharge amount VM, the discharge rate VC, the discharge angle θ, the aspect ratio AR, and the like.

The drive frequency f0 is a frequency for driving the drive element 31. As illustrated in FIG. 3, the drive frequency is the reciprocal of the period T0 of the drive pulse P0, and is expressed in kHz units, for example. The discharge amount VM means the amount of the liquid LQ discharged from the nozzle 13 when the drive pulse for acquiring the recording condition is applied to the drive element 31 for a predetermined period. For example, the discharge amount is represented by the volume of the droplet DR from the nozzle 13 in one period, and is expressed in pL units. The discharge rate VC means the rate of the liquid LQ discharged from the nozzle 13 when the drive pulse for acquiring recording conditions is applied to the drive element 31. For example, the discharge rate is represented by the discharge rate of the main droplet DR1 when the satellite DR2 is generated, or by the discharge rate of the droplet DR when the satellite DR2 is not generated. The discharge rate is expressed in m/s units. The discharge angle θ means the angle of the discharge direction D1 of the liquid LQ discharged from the nozzle 13 with respect to the reference direction when the drive pulse for acquiring the recording condition is applied to the drive element 31. The aspect ratio AR means an index value representing the shape of the liquid LQ discharged from the nozzle 13 when the drive pulse for acquiring the recording condition is applied to the drive element 31.

The target value means a value targeted by each discharge characteristic item in order to determine the waveform of the drive pulse P0. For example, the target value of the drive frequency f0 of the drive element 31 is XX kHz, which means that the waveform of the drive pulse P0 is determined with the aim of setting the drive frequency f0 to XX kHz. The allowable range means a range allowed using a target value when the waveform of the drive pulse P0 is determined, as the reference. For example, the allowable range of the drive frequency f0 is from −YY to +0 kHz, which means that the waveform of the drive pulse P0 having a drive frequency f0 which is equal to or higher than (XX−YY) kHz and is equal to or lower than (XX+0) kHz is adopted. The allowable range of the discharge amount VM is plus or minus YY pL, which means that the waveform of the drive pulse P0 is adopted when the discharge amount VM is equal to or greater than (XX−YY) pL and equal to or less than (XX+YY) pL.

The discharge amount VM of the liquid LQ may be calculated, for example, by dividing a weight value by the specific gravity of the liquid LQ. The weight value is obtained by dividing the weight of a predetermined number of droplets DR discharged from the nozzle 13 by the number of droplets. In this case, a weighing scale may be used for the detection device 300 illustrated in FIG. 1. One droplet DR may be applied onto a recording medium having known wettability with respect to the liquid LQ, and then the discharge amount VM of the liquid LQ may be calculated based on and the diameter, the penetration depth, and the wettability of the dots formed on the recording medium.

The discharge rate VC of the liquid LQ may be obtained, for example, by continuously capturing an image of the liquid LQ discharged from the nozzle 13 with a camera and analyzing a group of captured images. In this case, a camera or a video camera may be used for the detection device 300. In a case where the angle θ described later is 0 degrees, when the liquid LQ is discharged while scanning the liquid discharge head 11, a ratio between a distance between the position of a dot formed on a recording medium and the position of the liquid discharge head 11 in discharging the liquid, in a scanning direction, and a distance between the liquid discharge head 11 and the recording medium in a height direction is substantially equal to a ratio between a scanning speed of the liquid discharge head 11 and the discharge rate VC of the liquid LQ. It is possible to calculate the discharge rate VC of the liquid based on such a relation.

The drive frequency f0 of the drive element 31 may be obtained, for example, from the shape of the drive pulse P0 after being displayed on a visually recognizable system as illustrated in FIG. 3 or the like. The time displacement of the potential of the drive signal COM may be measured, and then the drive frequency may be obtained from the measurement result. In this case, a voltmeter may be used for the detection device 300.

Figure 7:
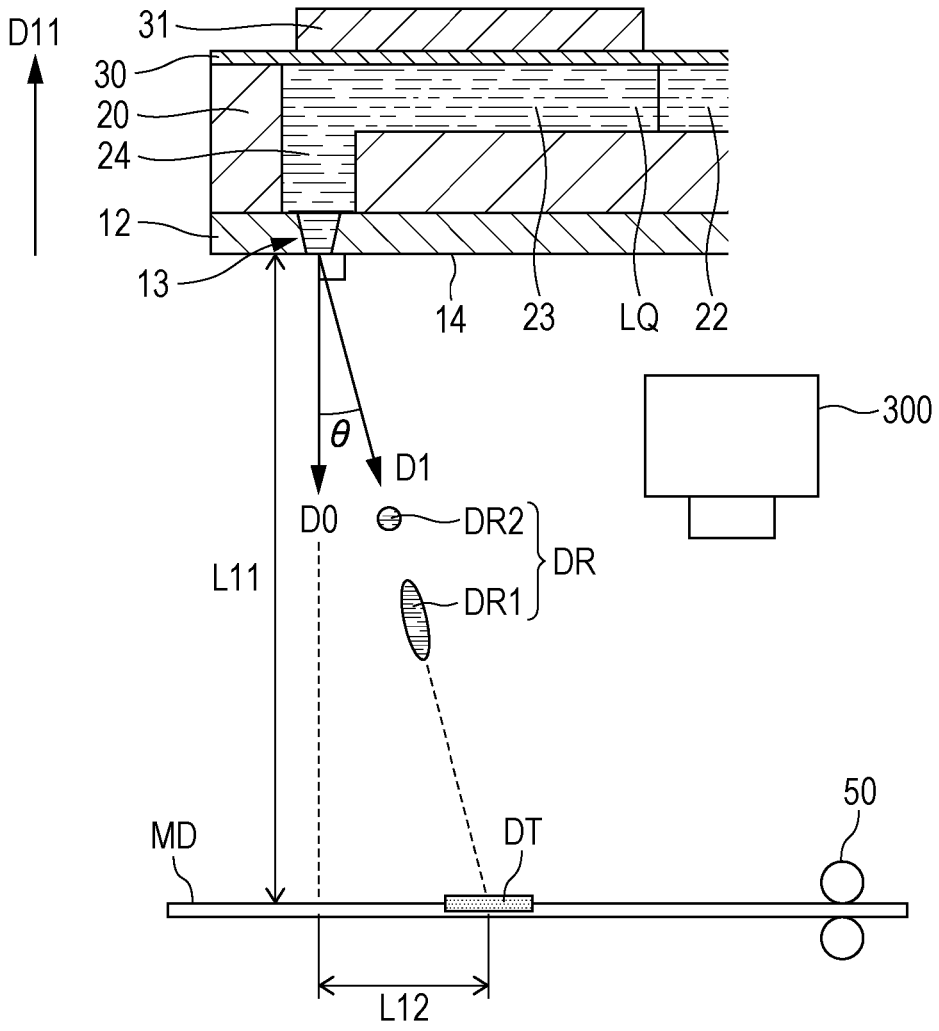
FIG. 7 is a schematic diagram illustrating a detection example of a discharge angle.

FIG. 7 schematically illustrates a detection example of the angle θ of the discharge direction D1 of the liquid LQ discharged from the nozzle 13. At this time, the liquid discharge head 11 discharges the liquid LQ, in a state of being stopped. When the ideal direction of the liquid LQ discharged from the nozzle 13 is set to the reference direction D0, the angle θ is defined as an angle of the discharge direction D1 of the liquid LQ discharged from the nozzle 13 with respect to the reference direction D0. Such an angle is referred to as the discharge angle θ. The reference direction D0 illustrated in FIG. 7 is a direction perpendicular to the nozzle surface 14. The discharge angle θ may be calculated, for example, by $\tan^{-1}$ (L12/L11) with a distance L11 between the nozzle surface 14 and the recording medium MD and a distance L12 from the position in the recording medium MD in the reference direction D0 from the nozzle 13 to the position at which the dot DT is formed on the recording medium. The distance L12 may be obtained, for example, by capturing an image of the recording medium MD having a dot DT with a camera and detecting a length corresponding to the distance L12 in the captured image. In this case, a camera or a video camera may be used for the detection device 300. In FIG. 7, the angle θ may be directly detected by capturing an image of the liquid LQ being lately discharged from the depth direction. An image of the liquid LQ being lately discharged may be captured from below.

Figure 8A:
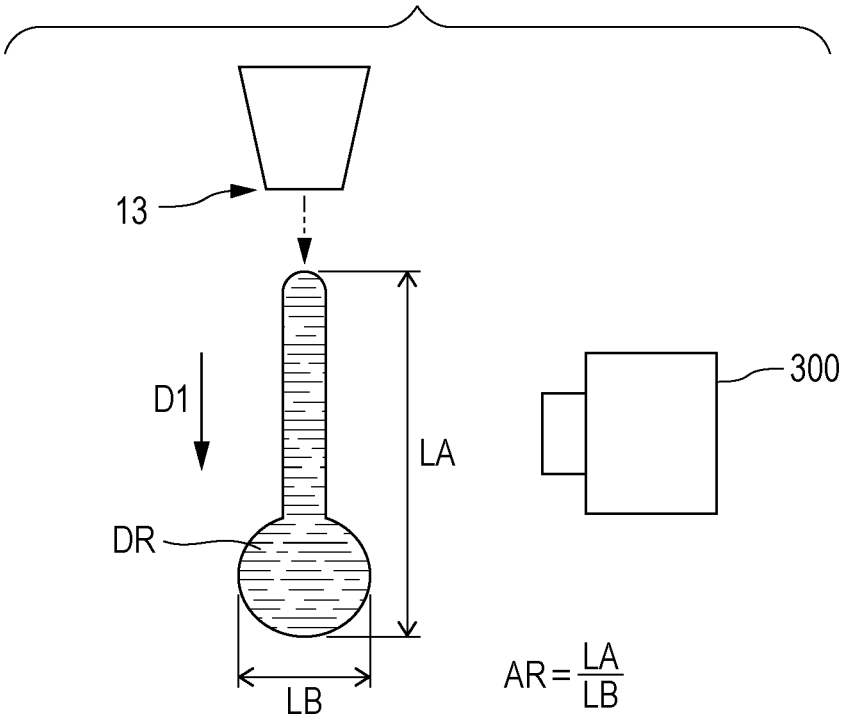
FIGS. 8A and 8B are schematic diagrams illustrating a detection example of a shape of a discharged liquid.
Figure 8B:
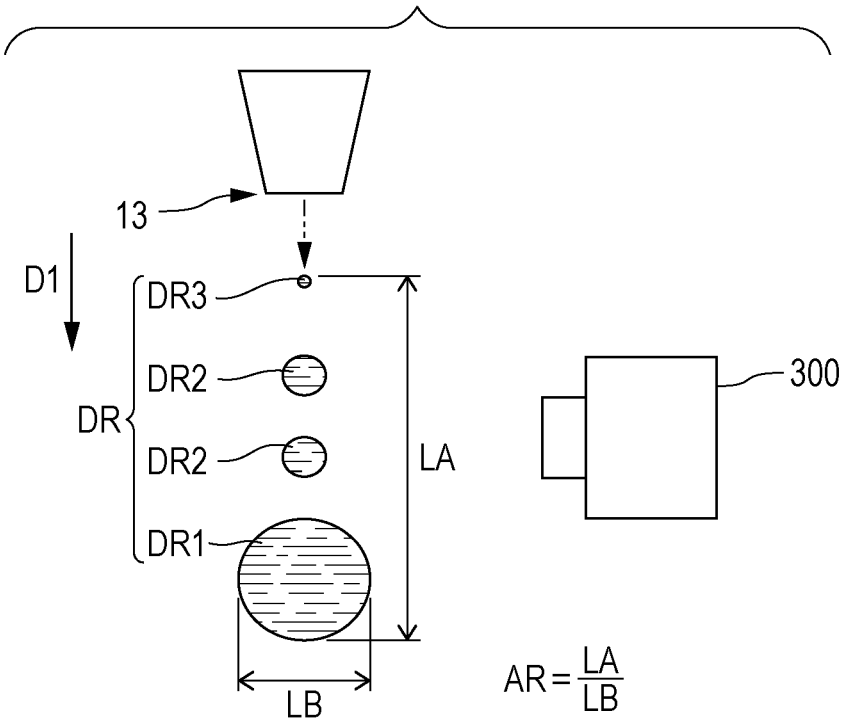

FIGS. 8A and 8B schematically illustrate a detection example of the shape of the discharged liquid. The liquid LQ discharged from the nozzle 13 includes not only a droplet DR which is not divided as illustrated in FIG. 8A, but also a droplet DR which is divided into the main droplet DR1 and the satellite DR2 as illustrated in FIG. 8B. Grandchild satellite DR3 may be generated in the droplet DR. Further, even a droplet DR that is not divided may have a columnar elongated shape.

Thus, the aspect ratio AR of the distribution of the liquid LQ discharged from the nozzle 13 is used as an index value of the shape of the discharged liquid. The aspect ratio AR may be calculated, for example, from the spatial distribution of the droplet DR shortly after the droplet is separated from the nozzle 13. Here, in the spatial distribution of the droplet DR, when the length in the longest direction is set as LA, and the length in a direction perpendicular to the longest direction described above is set as LB, the aspect ratio may be AR=LA/LB. In the spatial distribution of the droplet DR, the longest direction may often be the discharge direction D1. Thus, in the spatial distribution of the droplet DR, the length in the discharge direction D1 may be set as LA, and the length in the direction perpendicular to the discharge direction D1 may be set as LB. When the droplet DR is not divided as illustrated in FIG. 8A, LA/LB in the shape of the droplet DR is the aspect ratio AR. In this case, as the droplet DR becomes greater elongated in a columnar shape, the aspect ratio AR increases. As the droplet DR becomes closer to a spherical shape, the aspect ratio AR decreases. When the droplet DR is divided as illustrated in FIG. 8B, the aspect ratio AR is LA/LB including a space in which there is no liquid LQ. In this case, when the grandchild satellite DR3 is generated in the droplet DR, the aspect ratio AR increases.

The aspect ratio AR may be obtained, for example, by capturing an image of the droplet DR discharged from the nozzle 13 with a camera and detecting the lengths LA and LB in the captured image. In this case, a camera or a video camera may be used for the detection device 300.

(4) Specific Example of On-Paper Characteristic

Figure 9A:
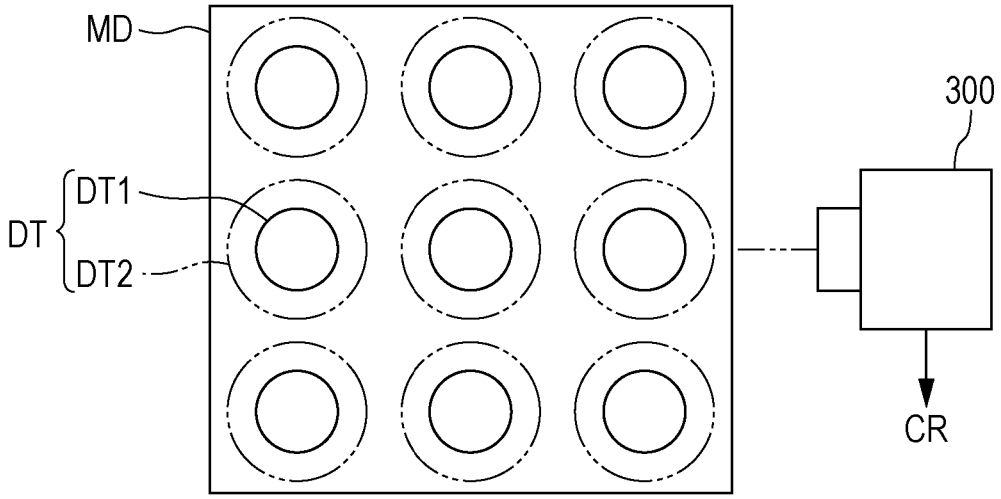
FIG. 9A is a schematic diagram illustrating a detection example of a dot coverage.
Figure 9B:
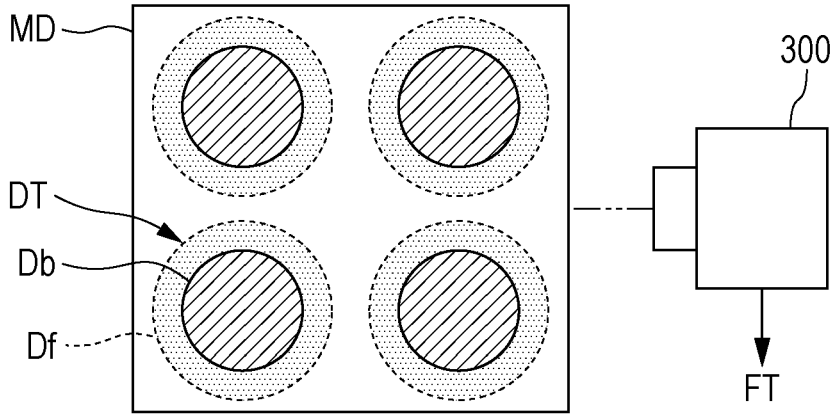
FIG. 9B is a schematic diagram illustrating a detection example of an oozing amount.
Figure 9C:
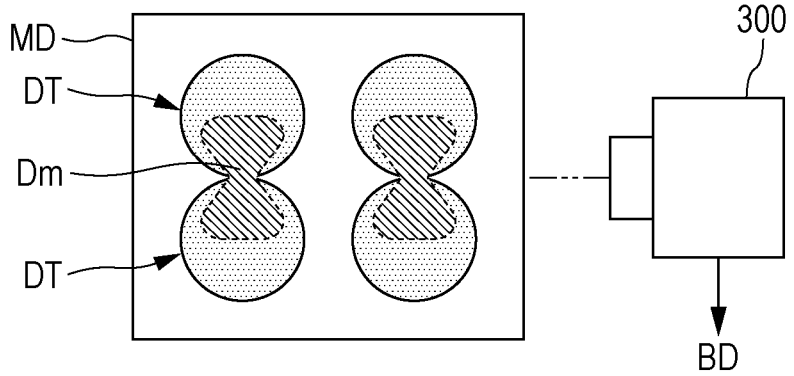
FIG. 9C is a schematic diagram illustrating a detection example of a bleeding amount.

FIGS. 9A to 9C schematically illustrate a detection example of the on-paper characteristic. The on-paper characteristic includes a coverage CR, an oozing amount FT, a bleeding amount BD, and the like of a dot DT.

FIG. 9A schematically illustrates a detection example of the coverage CR of a dot DT formed when the drive pulse for acquiring the recording condition is applied to the drive element 31. The coverage CR refers to a ratio of the occupied area of a dot DT formed on a recording medium MD when a predetermined number of droplets DR are discharged from the nozzle 13. The coverage CR may also be referred to as a ratio of the area occupied by the dot DT in the recording medium MD when a predetermined number of droplets DR are discharged, with respect to the unit area of the recording medium MD. FIG. 9A illustrates, as a schematic example, a form in which nine dots DT as a predetermined number are formed per unit area of the recording medium MD. Here, a dot DT1 indicated by a solid line is a relatively small dot, and a dot DT2 indicated by a two-dot chain line is a relatively large dot. The coverage CR of the relatively small dot DT1 is smaller than the coverage CR of the relatively large dot. The coverage CR of the dot DT may be obtained, for example, by capturing an image of the recording medium MD having the dot DT with a camera and detecting the ratio of the dot DT in the recording medium MD in the captured image. In this case, a camera or a video camera may be used for the detection device 300.

FIG. 9B schematically illustrates a detection example of the oozing amount FT of a dot DT formed when the drive pulse for acquiring the recording condition is applied to the drive element 31. The oozing amount FT refers to an oozing amount of the liquid LQ into the recording medium MD. The oozing amount FT may be referred to as an index value representing the amount of an oozing portion Df at which the droplet DR oozes from a body portion Db (corresponding to a portion at which the droplet DR lands on the recording medium MD). The phenomenon of a liquid oozing into a recording medium may also be referred to as feathering. The color of the oozing portion Df is different from the color of the body portion Db. Thus, when the oozing portion Df increases, the dot is recognized as color unevenness. Here, the oozing portion Df is a portion on which droplets to be originally fixed on the body portion Db flows and then is fixed. Thus, the image density at the oozing portion is lower than the image density at the body portion Db. Thus, for example, by storing a threshold value for the image density of the body portion Db and the image density of the oozing portion Df in advance, it is possible to determine a region having image density which is lower than the above-described threshold value in an image formed on the recording medium MD to be the oozing portion Df, and to determine a region having image density which is higher than the above-described threshold value in the image to be the body portion Db.

The oozing amount FT may be set to be, for example, a ratio of the area of the oozing portion Df to the area of the body portion Db. In this case, as the area ratio of the oozing portion Df to the body portion Db becomes larger, the oozing amount FT increases. The oozing amount FT may be obtained, for example, by capturing an image of a recording medium MD having a dot DT with a camera and detecting the ratio of the area of the oozing portion Df to the area of the body portion Db in the captured image. In this case, a camera or a video camera may be used for the detection device 300.

The oozing amount FT may be, for example, an average length from the outer edge of the body portion Db to the outer edge of the oozing portion Df.

The oozing amount FT may be obtained not only in dot units, that is, from a micro viewpoint, but also in image units, that is, from a macro viewpoint. For example, a 100% duty region in which the droplet DR is discharged from the nozzle 13 with 100% duty and a white paper region in which the droplet DR is not discharged from the nozzle 13 may be formed on a recording medium MD to be adjacent to each other. Then, the oozing amount FT between the 100% duty region and the white paper region may be obtained in a manner similar to the above description. Here, the 100% duty means that the droplet DR is landed on all the pixels on the recording medium MD.

The gravity center moment of the dot DT on the recording medium MD increases as the oozing portion Df becomes larger. Thus, the gravity center moment of the dot DT may be also used as the oozing amount FT. Here, the gravity center moment of the dot DT may be calculated, for example, by multiplying a distance between the gravity center position and the design center position of the dot DT, by the sum of the density of the pixels. The gravity center position is obtained from the position and the density of a pixel when the dot DT on the recording medium MD is divided by pixels. The density of a pixel means the density of a portion of the pixel in the dot DT. For example, the density of a pixel may be calculated from the brightness of the pixel.

As the oozing portion Df increases, the variation in the center position of the dot DT formed by the droplet DR discharged a plurality of times from the same nozzle 13 increases. This variation is represented, for example, by the standard deviation of a shift from the design center position of the dot DT to the center position of the actually formed dot DT.

FIG. 9C schematically illustrates a detection example of the bleeding amount BD of a dot DT formed when the drive pulse for acquiring the recording condition is applied to the drive element 31. The bleeding amount BD represents the degree of bleeding between the droplets DR that landed on the recording medium MD from the nozzle 13. The bleeding amount BD may be referred to as an index value representing the amount of a mixed portion Dm generated by the droplets DR attracting each other due to the difference in surface tension between the droplets DR on the recording medium MD. The phenomenon in which the droplets DR that land on the recording medium MD from the nozzle 13 bleed may be referred to as bleeding. The color of the mixed portion Dm is different from the color of the surrounding dots. Thus, the dot is recognized as color unevenness when the mixed portion Dm increases. In particular, in a case where the hues of the droplets DR landing on the recording medium MD are different from each other, when the droplets DR bleed, color unevenness is likely to be noticeable due to subtractive color mixing.

When the hues of two dots DT having the mixed portion Dm bleeding in the liquid state are different from each other, for example, the mixed portion Dm may be distinguished from the image on the recording medium MD in a manner as follows. Here, the hue angle of the first dot formed on the recording medium MD by only the first droplet is set as $\alpha 1$, and the hue angle of the second dot formed on the recording medium MD by only the second droplet is set as $\alpha 2$. The hue angle of the mixed portion Dm generated from the first droplet and the second droplet is set as $\alpha 3$. $\alpha 2$ is different from $\alpha 1$. The hue angle $\alpha 3$ of the mixed portion Dm is different from both $\alpha 1$ and $\alpha 2$. Thus, in the region of the two dots DT having the mixed portion Dm, it is possible to determine a portion having a hue angle different from both $\alpha 1$ and $\alpha 2$ to be the mixed portion Dm and to determine a portion having the hue angle of $\alpha 1$ or $\alpha 2$ to be a region which is not the mixed portion Dm. Since the hue of the dots may fluctuate to some extent other than bleeding, the condition of the hue angle for determining the region which is not the mixed portion Dm may be slightly-flexibly set. For example, in the region of the two dots DT having the mixed portion Dm, it is possible to determine a portion having a hue angle which is not in a range from $\alpha 1 \times 9/10$ to $\alpha 1 \times 11/10$ and not in a range from $\alpha 2 \times 9/10$ to $\alpha 2 \times 11/10$, to be the mixed portion Dm.

It is possible to distinguish the mixed portion Dm by the density of a partial region of the dot DT or the like in addition to the hue angle. The density of the partial region may be calculated, for example, from the brightness of the partial region.

The bleeding amount BD may be, for example, set to be a ratio of the area of the mixed portion Dm to the total area of the dot DT. In this case, as the area ratio of the mixed portion Dm becomes larger, the bleeding amount BD increases. The bleeding amount BD may be obtained, for example, by capturing an image of a recording medium MD having a dot DT with a camera and detecting the ratio of the area of the mixed portion Dm to the total area of the dot DT in the captured image. In this case, a camera or a video camera may be used for the detection device 300.

The bleeding amount BD may be obtained not only in dot units, that is, from a micro viewpoint, but also in image units, that is, from a macro viewpoint. For example, a first region in which a first droplet is discharged from the nozzle 13 with 100% duty and a second region in which a second droplet is discharged from the nozzle 13 with 100% duty may be formed on a recording medium MD to be adjacent to each other. Then, the bleeding amount BD between the first region and the second region may be obtained in a manner similar to the above description.

(5) Specific Example of Drive Pulse Setting Procedure

Figure 10:
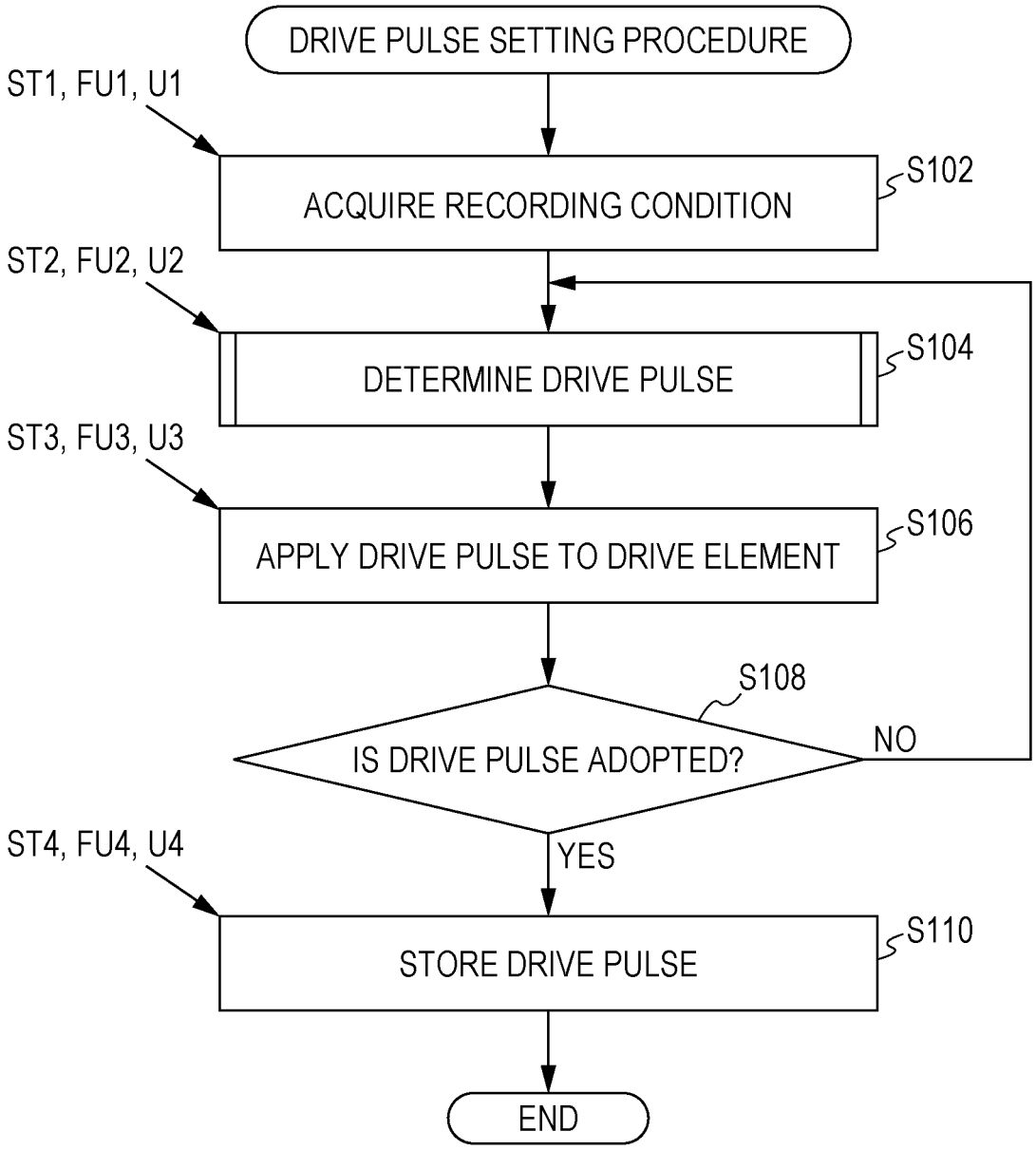
FIG. 10 is a flowchart illustrating an example of a drive pulse setting procedure.

FIG. 10 illustrates an example of a drive pulse setting procedure of setting different drive pulses P0 in accordance with the recording condition including the discharge characteristic and the on-paper characteristic. The drive pulse setting procedure is performed by the computer 200 that executes the drive pulse determination program PRO. Here, Step S102 corresponds to the acquisition step ST1, the acquisition function FU1, and the acquisition unit U1. Step S104 corresponds to the determination step ST2, the determination function FU2, and the determination unit U2. Step S106 corresponds to the driving step ST3, the application control function FU3, and the driving unit U3. Step S110 corresponds to the storing step ST4, the storing function FU4, and the storage processing unit U4. The description of "Step" will be omitted below. When the drive pulse setting procedure is performed, the liquid discharge method in the present technology is implemented. The computer 200 and the apparatus 10 correspond to the liquid discharge apparatus in the present technology.

The computer 200 performs drive pulse setting process in accordance with the drive pulse setting procedure. When the drive pulse setting process starts, the computer 200 performs a recording condition acquisition process of acquiring the recording condition 400 (S102). The computer 200 automatically acquires the recording condition 400 based on the drive result when a predetermined default drive pulse P0 is applied to the drive element 31. That is, in the following description, the recording condition 400 refers to a value associated with the default drive pulse P0. Details of acquiring the recording condition 400 will be described later.

After acquiring the recording condition 400, the computer 200 performs a drive pulse determination process of determining the drive pulse P0 to be applied in the subsequent S106, based on the recording condition 400, such that the actual discharge characteristics and the on-paper characteristics enter into the allowable ranges of the target value (S104). The computer 200 may automatically determine one drive pulse P0 to be applied in S106 from a plurality of drive pulses based on the recording condition 400 such that the actual discharge characteristics and the on-paper characteristics enter into the allowable ranges of the target value. Details of determining the drive pulse P0 to be applied in S106 will be described later.

Then, the computer 200 performs an application control process of applying the drive pulse P0 determined in S104 to the drive element 31 (S106). For example, the computer 200 may transmit the waveform information 60 representing the drive pulse P0 determined in S104, to the apparatus 10 together with a discharge request. In this case, the apparatus 10 including the liquid discharge head 11 may perform a process of receiving the waveform information 60 together with the discharge request, a process of storing the waveform information 60 in the memory 43, and a process of applying the drive pulse P0 corresponding to the waveform information 60 to the drive element 31. As a result, the liquid LQ is discharged from the nozzle 13 to have the discharge characteristic in the allowable range of the target value. When the discharged droplet DR lands on the recording medium MD, a dot DT is formed on a recording medium MD to have the on-paper characteristic in the allowable range of the target value. Thus, the computer 200 and the apparatus 10 cooperate to perform the driving step ST3, the computer 200 and the apparatus 10 serve as the driving unit U3, and the computer 200 performs the application control function FU3.

After the drive pulse P0 is applied, the computer 200 branches the process in accordance with whether or not the drive pulse P0 applied in S106 is adopted (S108). For example, when the computer 200 receives an operation of adopting the applied drive pulse P0 by a user from the input device 205, the computer 200 causes the process to proceed to S110. When the computer 200 receives an operation of not adopting the drive pulse P0 by the user from the input device 205, the computer 200 causes the process to return to S104. The computer 200 may automatically determine whether or not to adopt the drive pulse P0 based on the drive result of S106.

When the condition is satisfied, the computer 200 performs a storing process of storing the waveform information 60 indicating the waveform of the drive pulse P0 determined in S104, in the storage unit in association with the identification information ID of the liquid discharge head 11 (S110). For example, when the storage unit is the memory 43 of the apparatus 10 illustrated in FIG. 1, the computer 200 may transmit the waveform information 60 indicating the waveform of the drive pulse P0 determined in S104, to the apparatus 10 together with a storing request. In this case, the apparatus 10 including the liquid discharge head 11 may perform a process of receiving the waveform information 60 together with the storing request and a process of storing the waveform information 60 in the memory 43. In this manner, in the storing step ST4, the waveform information 60 is transmitted by the computer 200 outside the storage unit to store the waveform information 60 in the storage unit in association with the identification information ID. When the apparatus 10 applies the drive pulse P0 corresponding to the waveform information 60 stored in the memory 43, to the drive element 31, the liquid LQ is discharged from the nozzle 13 to have the discharge characteristic in accordance with the recording condition 400, and thus a dot DT is formed on a recording medium MD to have the on-paper characteristic in accordance with the recording condition 400.

The storage device 204 in the computer 200 may be the storage unit. In this case, the computer 200 stores the waveform information 60 in the storage device 204, in association with the identification information ID. Although details will be described later, a storage device of a server computer coupled to the computer 200 may be the storage unit.

When the drive pulse P0 is stored, the drive pulse setting procedure illustrated in FIG. 10 ends.

(6) Description of Drive Pulse Determination Procedure

Figure 11:
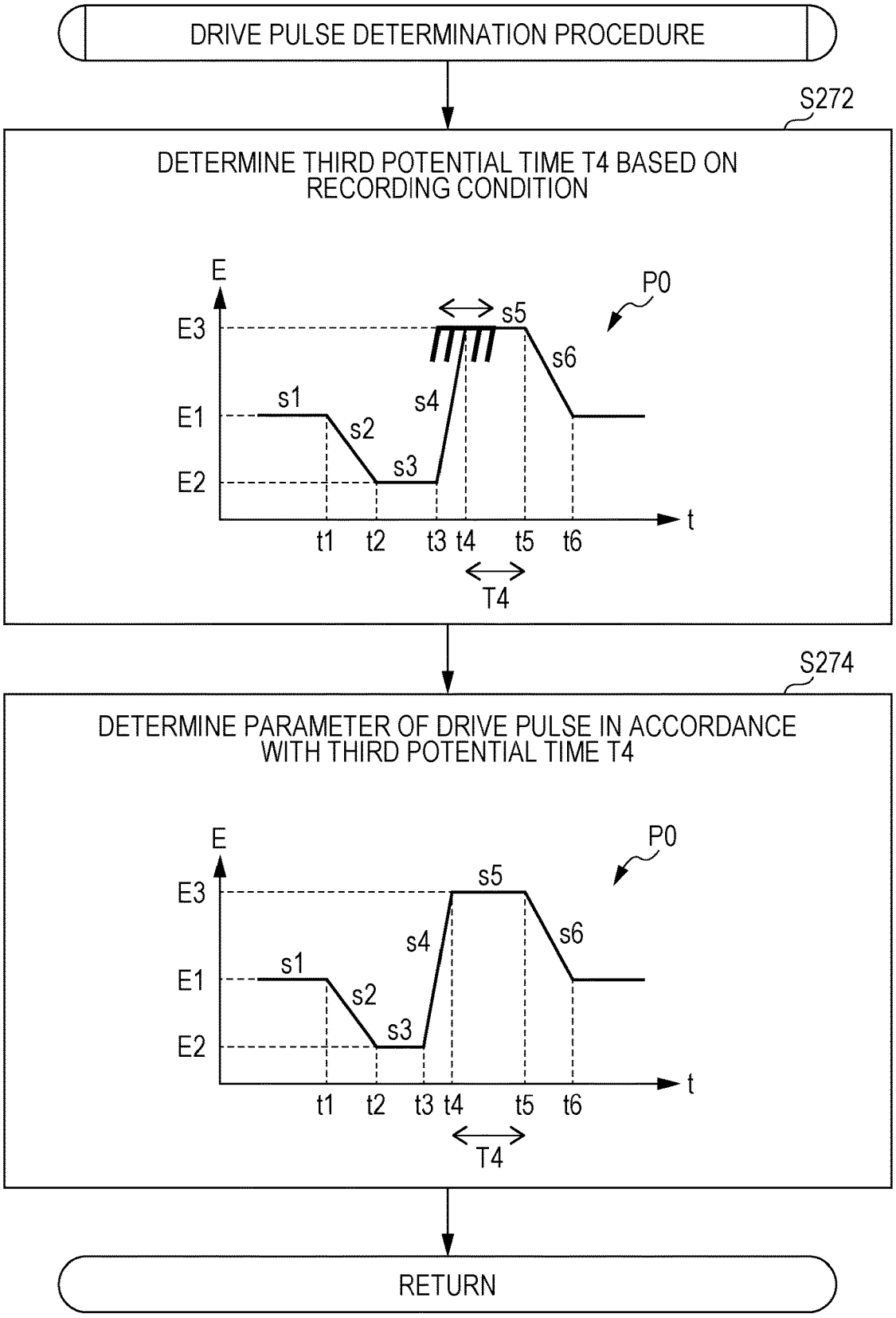
FIG. 11 is a flowchart illustrating an example of a drive pulse determination procedure.

FIG. 11 illustrates an example of a drive pulse determination procedure performed in S104 of FIG. 10. The drive pulse determination procedure is performed by the computer 200.

In the present specific example, focusing on that it is possible to control discharge characteristics of the liquid discharge head 11 and on-paper characteristics by changing the time T4 of the third potential E3 illustrated in FIGS. 3, 5A, and 5B, the drive pulse P0 having the time T4 of the third potential E3, that varies depending on the recording condition 400 is determined. The time T4 of the third potential E3 is set to be also referred to as a third potential time T4.

The computer 200 performs the drive pulse determination process in accordance with the drive pulse determination procedure. When the drive pulse determination process is started, the computer 200 performs a third potential time determination process of determining the third potential time T4 based on the recording condition 400 acquired in S102 of FIG. 10 (S272). The computer 200 automatically determines the third potential time T4 based on the recording condition 400. A process of acquiring the third potential time T4 is included in the process of determining the third potential time T4. Details for determining the third potential time T4 will be described later.

After determining the third potential time T4, the computer 200 performs a parameter determination process of determining the parameter of the drive pulse P0 in accordance with the third potential time T4 (S274). This is because changing the third potential time T4 from the default drive pulse also requires changing some of the other parameters. Describing with reference to FIG. 3, the other parameters of the drive pulse P0 include the potential change rates ΔE(s2), ΔE(s4), and ΔE(s6) in the states s2, s4, and s6, the time T2 of the second potential E2, the time T6 of the first potential E1, the period T0, and the like. The computer 200 may automatically determine the other parameters based on the third potential time T4. When a plurality of different drive pulses are prepared in accordance with the third potential time T4, the computer 200 may select one drive pulse from the plurality of prepared drive pulses. The drive pulse having a preset third potential time T4 which is equal to or the closest to the preset third potential time T4 is selected by the computer. This case is also included in the determination of the parameter of the drive pulse P0 in accordance with the third potential time T4. Waveform information representing the plurality of prepared drive pulses is stored in the storage device 204, and thereby the computer 200 is capable of using the waveform information read from the storage device 204, for a selection process of the drive pulse. The process of acquiring the other parameters is included in the process of determining the parameter of the drive pulse P0.

When the parameter of the drive pulse P0 is determined, the drive pulse determination procedure is completed, and the procedures after S106 in FIG. 10 are performed.

Figure 12A:
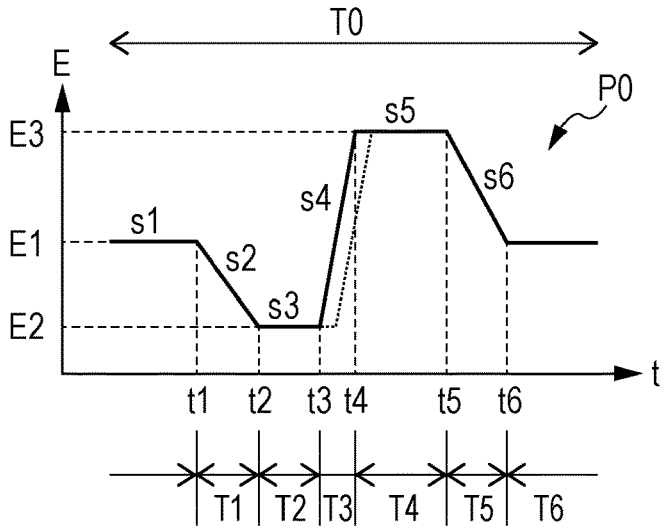
FIG. 12A to 12C are schematic diagrams illustrating examples of determining parameters of the drive pulse in accordance with a third potential time.
Figure 12B:
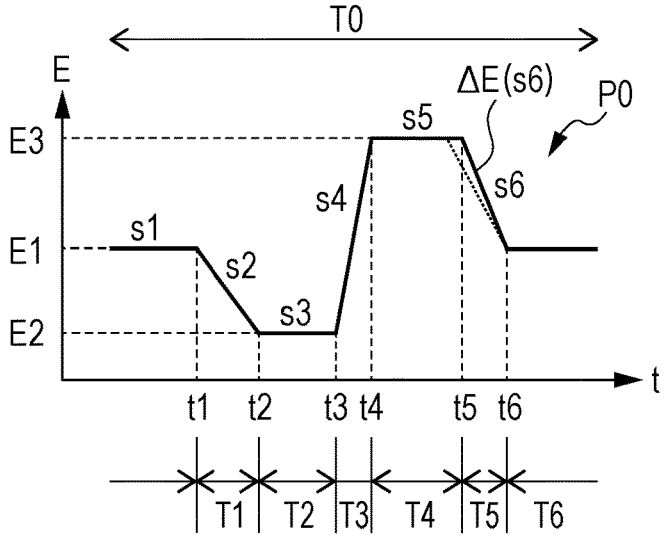
Figure 12C:
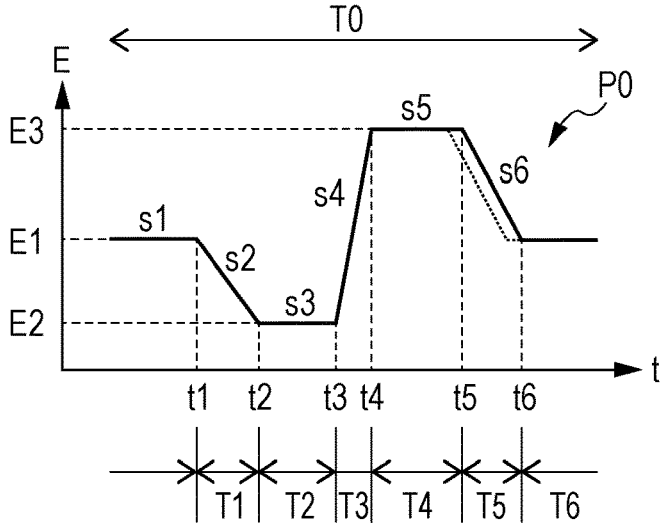

Next, an example of determining the parameter of the drive pulse P0 in accordance with the third potential time T4 will be described with reference to FIGS. 12A to 12C. In FIGS. 12A to 12C, a horizontal axis indicates the time t, and a vertical axis indicates the potential E. In FIGS. 12A to 12C, the waveform of the drive pulse P0 illustrated in FIG. 3 is used as the default, and the waveform changed from the default waveform is indicated by a thick line.

FIG. 12A illustrates the example in which the time T2 of the second potential E2 in the state s3 is changed in response to the change of the third potential time T4. As a premise, the period T0 is not changed, the timings t1, t2, t5, and t6 are not changed, and the potential change rates in the states s2, s4, and s6 in which the potential changes are not changed. As illustrated in FIG. 12A, when the third potential time T4 becomes longer than the default waveform, the timings t3 and t4 become earlier, and the time T2 of the second potential E2 becomes shorter. Although not shown, when the third potential time T4 becomes shorter than the default waveform, the timings t3 and t4 are delayed, and the time T2 of the second potential E2 becomes longer.

FIG. 12B illustrates an example in which the potential change rate ΔE(s6) in the state s6 in which the potential changes from the third potential E3 to the first potential E1 is changed in response to the change of the third potential time T4. As a premise, the period T0 is not changed, the timings t1 to t4 and t6 are not changed, and the potential change rates ΔE(s2) and ΔE(s4) in the states s2 and s4 are not changed. As illustrated in FIG. 12B, when the third potential time T4 becomes longer than the default waveform, the timing t5 is delayed, and the potential change rate ΔE(s6) increases. Although not illustrated, when the third potential time T4 decreases from the default waveform, the timing t5 become earlier, and the potential change rate ΔE(s6) becomes smaller.

FIG. 12C illustrates an example in which the period T0 of the drive pulse P0 is changed in response to the change of the third potential time T4. As a premise, the potential change rates in the states s2, s4, and s6 in which the potential changes are not changed, the time T2 of the second potential E2 in the state s3 is not changed, and the time T6 in the state of the first potential E1 is not changed either. As illustrated in FIG. 12C, when the third potential time T4 becomes longer than the default waveform, the period T0 becomes longer. Although not shown, when the third potential time T4 decreases from the default waveform, the period T0 becomes shorter.

The method of determining the parameter of the drive pulse P0 in accordance with the third potential time T4 is not limited to the above-described example. For example, both the time T2 of the second potential E2 and the time T6 of the first potential E1 may be changed in response to the change of the third potential time T4. Both the time T2 of the second potential E2 and the potential change rate ΔE(s6) may be changed in response to the change of the third potential time T4.

In the following description, a case where the recording condition 400 is acquired when one of a plurality of liquid discharge heads having variations in recording condition due to manufacturing errors and the like is used, and the drive pulse P0 to be applied to the used liquid discharge head is determined to bring recording by the liquid discharge head closer to the ideal condition will be described. The one liquid discharge head at this time will be described as a "target liquid discharge head" in the following description. When there is no significant change in the discharge characteristics or the on-paper characteristic of the liquid discharge head, an individual recording condition 400 based on the drive result obtained when the default drive pulse P0 is applied to the drive element 31 is assigned to one liquid discharge head. Thus, in this case, the "target liquid discharge head" to which a first recording condition is assigned is different from the "target liquid discharge head" to which a second recording condition different from the first recording condition is assigned. When the liquid discharge head is used, the discharge characteristics and the on-paper characteristic may change due to the lapse of time from the start of use, or may change due to changes in the use environment. In this case, for one liquid discharge head, the default drive pulse P0 is applied to the drive element 31 for each use timing or use environment. Thus, the individual recording condition 400 according to the use timing or the use environment is assigned to the one liquid discharge head based on the drive result of applying the default drive pulse. Thus, in this case, the "target liquid discharge head" to which the first recording condition is assigned is the same as the "target liquid discharge head" to which the second recording condition different from the first recording condition is assigned.

(7) Description of Specific Example of Determining Drive Pulse in Accordance with Recording Condition An example of determining the drive pulse P0 having the third potential time T4 that varies depending on the recording condition 400 will be described below with reference to FIG. 13 and the subsequent drawings. In the following description, it is assumed that the drive pulse P0 has a waveform of which the third potential time T4 is changed with the waveform illustrated in FIG. 3 as the default. The recording condition acquisition procedure means the procedure of S102 illustrated in FIG. 10, and the drive pulse determination procedure means the procedure of S104 illustrated in FIG. 10.

Firstly, a case where the discharge characteristic of the liquid LQ from the liquid discharge head 11 is acquired as the recording condition 400 in the recording condition acquisition procedure will be described. As illustrated in FIG. 6, the discharge characteristics include the drive frequency f0, the discharge amount VM, the discharge rate VC, the discharge angle θ, the aspect ratio AR, and the like.

Figure 13:
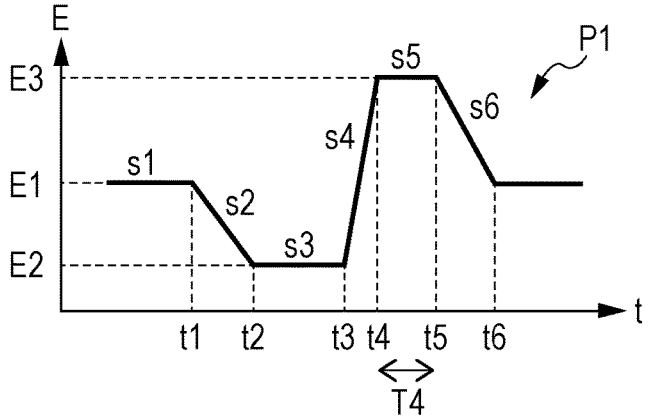
FIG. 13 is a schematic diagram illustrating an example of determining the drive pulse having the third potential time that varies depending on the discharge angle of the liquid.
Figure 13:
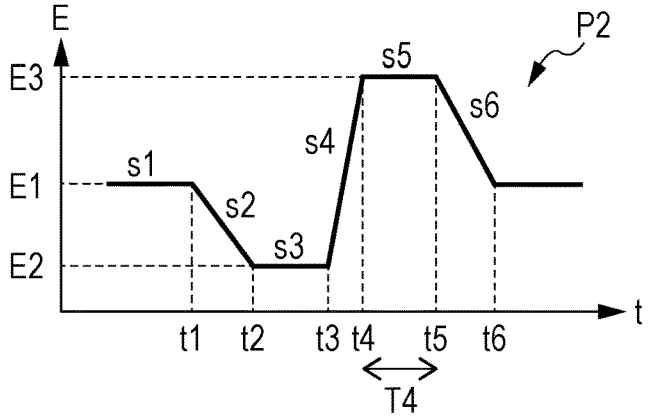
Figure 13:
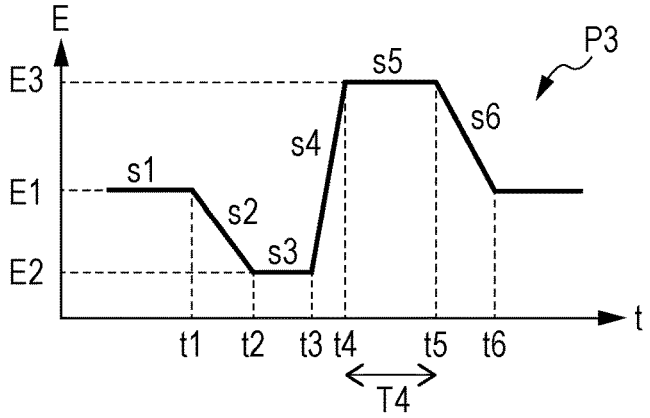

FIG. 13 schematically illustrates an example of the drive pulse determination procedure of determining the drive pulse P0 having the third potential time T4 that varies depending on the discharge angle θ when the recording condition acquisition procedure of acquiring the discharge angle θ as the recording condition 400 is performed. When the ideal direction of the liquid LQ discharged from the nozzle 13 is set to the reference direction D0, the discharge angle θ is defined as an angle of the discharge direction D1 of the liquid LQ discharged from the nozzle 13 with respect to the reference direction D0, as illustrated in FIG. 7. The drive pulse P0 illustrated in FIG. 13 has a waveform in which the third potential time T4 is changed as illustrated in FIG. 12A.

Firstly, the relation between the discharge angle θ and the third potential time T4 when the third potential time T4 of the drive pulse P0 is relatively short will be described.

As a result of the test, a tendency that, when the third potential time T4 is relatively short, the discharge angle θ decreases as the third potential time T4 becomes longer has been found. From this tendency, the followings are understood. That is, when it is desired to decrease the discharge angle of the liquid LQ actually discharged from the nozzle 13 because the discharge angle θ is large, the third potential time T4 may be set to be increased. When the actual discharge angle is small, the third potential time T4 may be set to be decreased.

In the example illustrated in FIG. 13, the drive pulse P0 adjusted when the discharge angle θ acquired as the recording condition 400 for the target liquid discharge head is the first angle θ1 is set to be referred to as the first drive pulse P1. The drive pulse P0 having the third potential time T4 which is longer than the third potential time of the first drive pulse P1 is set to be referred to as the second drive pulse P2. The relation between the first drive pulse P1 and the second drive pulse P2 with respect to the magnitude of the third potential time T4 is similarly applied in the following description. When three or more drive pulses P0 having different waveforms are applied to the drive element 31, drive pulses that are freely selected from the three or more drive pulses P0 in a range satisfying the magnitude relation of the third potential time T4 may be applied as the first drive pulse P1 and the second drive pulse P2. Such application is the same in the following description.

In the drive pulse determination procedure, when the acquired discharge angle θ is the first angle θ1, the first drive pulse P1 is determined as the drive pulse P0 to be applied to the drive element 31 such that the actual discharge angle enters into the allowable range of the target value illustrated in FIG. 6.

Regarding another target liquid discharge head, the discharge angle θ acquired as the recording condition 400 is set to a second angle θ2 which is larger than the first angle θ1, and the actual discharge angle is set to be desired to decrease to enter into the allowable range of the target value. In this case, in the drive pulse determination procedure, the second drive pulse P2 having the third potential time T4 which is longer than the third potential time of the first drive pulse P1 is determined as the drive pulse to be applied to the drive element 31 such that the actual discharge angle enters into the allowable range of the target value. Thus, because the actual discharge angle of the target liquid discharge head is adjusted to be reduced, the difference between the actual discharge angle and the target discharge angle of the target liquid discharge head is reduced.

In the drive pulse determination procedure, a threshold value of the discharge angle θ may be set as T0, and the threshold value T0 may be set between the first angle θ1 and the second angle θ2. In this case, in the drive pulse determination procedure, for example, the first drive pulse P1 may be determined as the drive pulse P0 to be applied to the drive element 31 when the discharge angle θ is smaller than the threshold value T0. The second drive pulse P2 may be determined as the drive pulse P0 to be applied to the drive element 31 when the discharge angle θ is equal to or larger than the threshold value T0.

In the drive pulse P0 illustrated in FIG. 13, the time T2 of the second potential E2 illustrated in FIG. 3 changes in response to the change of the third potential time T4. The time T2 of the second potential E2 in the second drive pulse P2 is shorter than the time T2 in the first drive pulse P1. In this example, even though the third potential time T4 is changed, it is possible to suppress the change of the period T0 of the drive pulse P0. Thus, it is possible to provide the appropriate drive pulse P0 in response to the change of the third potential time T4.

The waveform information 60 representing the determined drive pulse P0 is stored, for example, in the memory 43 illustrated in FIG. 1 and is used when the drive signal generation circuit 45 generates the drive signal COM. The drive pulse P0 in the drive signal COM is applied to the drive element 31.

From the above description, the liquid discharge method in the present specific example includes, in the driving step ST3, applying the first drive pulse P1 to the drive element 31 when the discharge angle θ acquired as the recording condition 400 is the first angle θ1, and applying the second drive pulse P2 to the drive element 31 when the discharge angle θ acquired as the recording condition 400 is the second angle θ2 larger than the first angle θ1. Thus, in the present specific example, when the third potential time T4 is relatively short, it is possible to reduce the variation in the discharge angle of the liquid LQ actually discharged from the nozzle 13 in accordance with the discharge angle θ as the discharge characteristic.

As illustrated in FIG. 13, the drive pulse P0 having the third potential time T4 which is longer than the third potential time of the second drive pulse P2 may also be referred to as a third drive pulse P3. In other words, the third drive pulse P3 has the third potential time T4 which is longer than the third potential time of the second drive pulse P2.

Regarding the target liquid discharge head, the discharge angle θ acquired as the recording condition 400 is set to a third angle θ3 which is larger than the second angle θ2, and the actual discharge angle is set to be desired to decrease. In this case, in the drive pulse determination procedure, the third drive pulse P3 having the third potential time T4 which is longer than the third potential time of the second drive pulse P2 is determined as the drive pulse to be applied to the drive element 31. Thus, because the actual discharge angle of the target liquid discharge head is adjusted to be reduced, the difference between the actual discharge angle and the target discharge angle is reduced even when the discharge angle θ is the third angle θ3. Four or more types of drive pulses may be determined. In the following various examples, the plurality of drive pulses P0 may include the third drive pulse P3, and the number of determined drive pulses may be four or more.

In the drive pulse determination procedure, two threshold values of the discharge angle θ are set to Tθ1 and Tθ2, respectively. The threshold value Tθ1 may be set between the first angle θ1 and the second angle θ2, and the threshold value Tθ2 may be set between the second angle θ2 and the third angle θ3. In this case, in the drive pulse determination procedure, for example, the first drive pulse P1 may be determined as the drive pulse P0 to be applied to the drive element 31 when the discharge angle θ is smaller than the threshold value Tθ1. The second drive pulse P2 may be determined as the drive pulse P0 to be applied to the drive element 31 when the discharge angle θ is equal to or larger than the threshold value Tθ1 and smaller than the threshold value Tθ2. The third drive pulse P3 may be determined as the drive pulse P0 to be applied to the drive element 31 when the discharge angle θ is equal to or larger than the threshold value Tθ2. Even when four or more types of drive pulses are determined, it is possible to determine the drive pulses using the threshold value in the similar manner.

Figure 14:
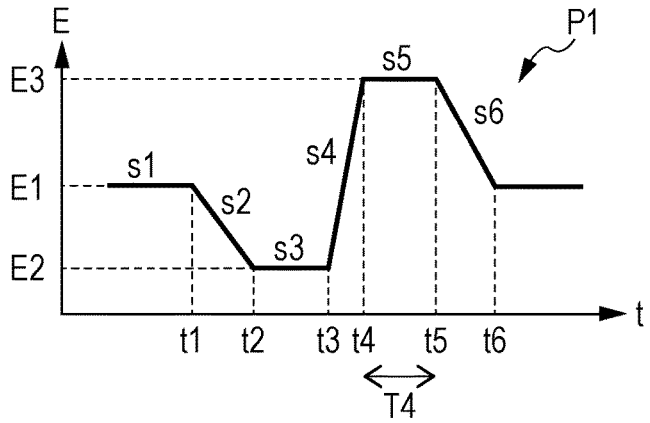
FIG. 14 is a schematic diagram illustrating another example of determining the drive pulse having the third potential time that varies depending on the discharge angle of the liquid.
Figure 14:
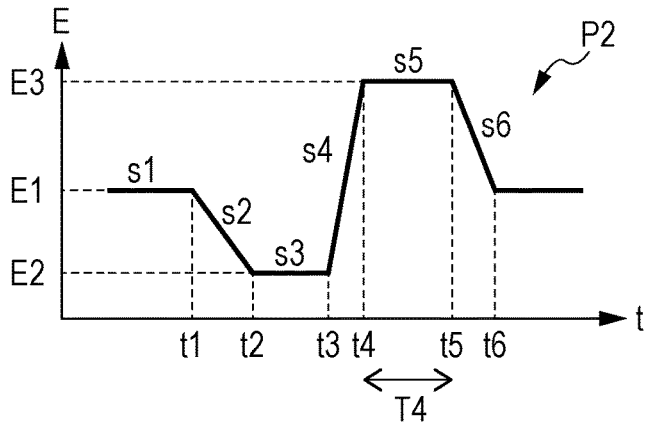

FIG. 14 also schematically illustrates an example of the drive pulse determination procedure of determining the drive pulse P0 having the third potential time T4 that varies depending on the discharge angle θ when the recording condition acquisition procedure of acquiring the discharge angle θ as the recording condition 400 is performed. The drive pulse P0 illustrated in FIG. 14 has a waveform in which the third potential time T4 is changed as illustrated in FIG. 12B. Similar to the example illustrated in FIG. 13, in the drive pulse determination procedure, when the acquired discharge angle θ is the first angle θ1, the first drive pulse P1 is determined as the drive pulse P0 to be applied to the drive element 31 such that the actual discharge angle enters into the allowable range of the target value illustrated in FIG. 6. In the drive pulse determination procedure, when the acquired discharge angle θ is the second angle θ2, the second drive pulse P2 is determined as the drive pulse P0 to be applied to the drive element 31 such that the actual discharge angle enters into the allowable range of the target value.

In the drive pulse P0 illustrated in FIG. 14, the potential change rate ΔE(s6) illustrated in FIG. 3 changes in response to the change of the third potential time T4. (n the second drive pulse P2, the potential change rate ΔE(s6) in the state s6 in which the potential changes from the third potential E3 to the first potential E1 is greater than the potential change rate ΔE(s6) in the first drive pulse P1. In this example, even though the third potential time T4 is changed, it is possible to suppress the change of the period T0 of the drive pulse P0. Thus, it is possible to provide the appropriate drive pulse P0 in response to the change of the third potential time T4.

The determined drive pulse P0 is applied to the drive element 31. In the specific example illustrated in FIG. 14, when the third potential time T4 is relatively short, it is also possible to reduce the variation in the discharge angle of the liquid LQ actually discharged from the nozzle 13 in accordance with the discharge angle θ as the discharge characteristic.

Figure 15:
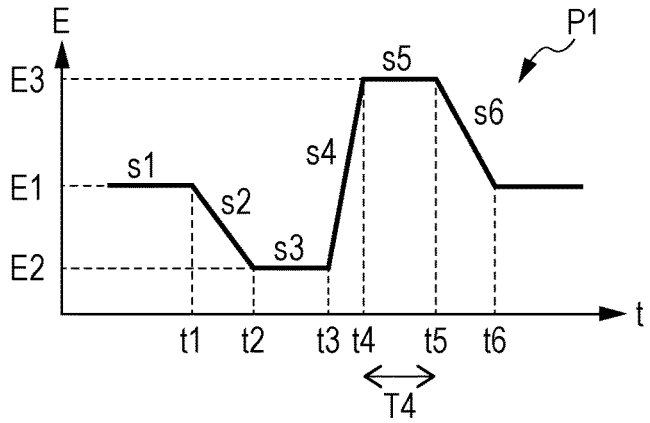
FIG. 15 is a schematic diagram illustrating still another example of determining the drive pulse having the third potential time that varies depending on the discharge angle of the liquid.
Figure 15:
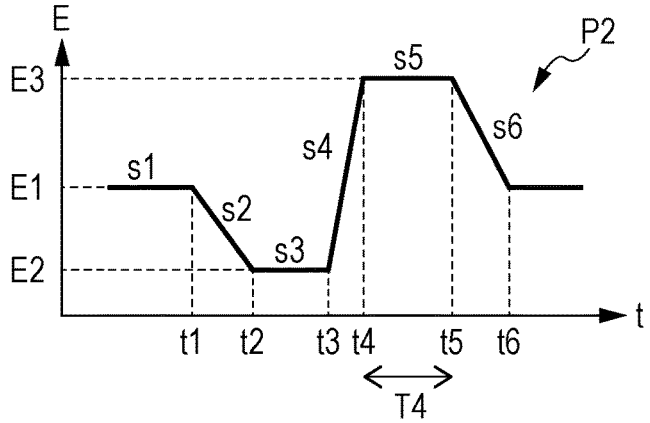

FIG. 15 also schematically illustrates an example of the drive pulse determination procedure of determining the drive pulse P0 having the third potential time T4 that varies depending on the discharge angle θ when the recording condition acquisition procedure of acquiring the discharge angle θ as the recording condition 400 is performed. The drive pulse P0 illustrated in FIG. 15 has a waveform in which the third potential time T4 is changed as illustrated in FIG. 12C. Similar to the example illustrated in FIG. 13, in the drive pulse determination procedure, when the acquired discharge angle θ is the first angle θ1, the first drive pulse P1 is determined as the drive pulse P0 to be applied to the drive element 31 such that the actual discharge angle enters into the allowable range of the target value illustrated in FIG. 6. In the drive pulse determination procedure, when the acquired discharge angle θ is the second angle θ2, the second drive pulse P2 is determined as the drive pulse P0 to be applied to the drive element 31 such that the actual discharge angle enters into the allowable range of the target value.

In the drive pulse P0 illustrated in FIG. 15, the period T0 being the time of one cycle changes in response to the change of the third potential time T4. The period T0 of the second drive pulse P2 is longer than the period T0 of the first drive pulse P1. In this example, even though the third potential time T4 is changed, the potential change rates ΔE(s2), ΔE(s4), and ΔE(s6) illustrated in FIG. 3 do not change, and the time T2 of the second potential E2 in the state s3 does not change. The time T6 in the state of the first potential E1 does not change either. Thus, in this example, it is possible to provide an appropriate drive pulse P0 in response to the change of the third potential time T4.

Although not illustrated in FIGS. 14 and 15, a plurality of drive pulses P0 including the examples illustrated in FIGS. 14 and 15 may also include the third drive pulse P3, and four or more types of drive pulses may be determined.

Even though various waveforms of the drive pulse P0 including the examples illustrated in FIGS. 5A and 5B are the default waveforms, the similar action occurs. Thus, when the third potential time T4 is relatively short, the variation in the discharge angle of the liquid LQ actually discharged from the nozzle 13 in accordance with the discharge angle θ is reduced.

Figure 16:
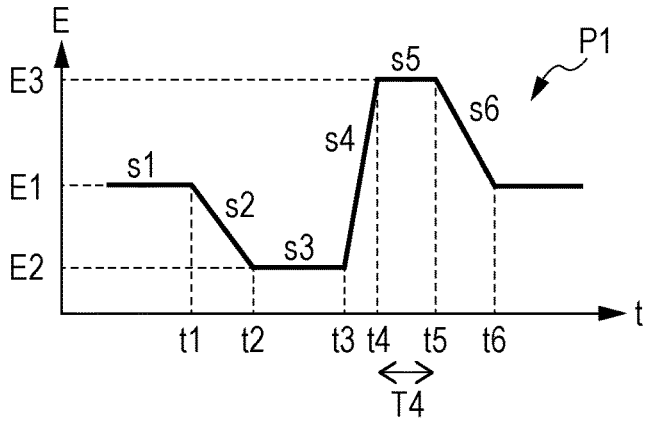
FIG. 16 is a schematic diagram illustrating still yet another example of determining the drive pulse having the third potential time that varies depending on the discharge angle of the liquid.
Figure 16:
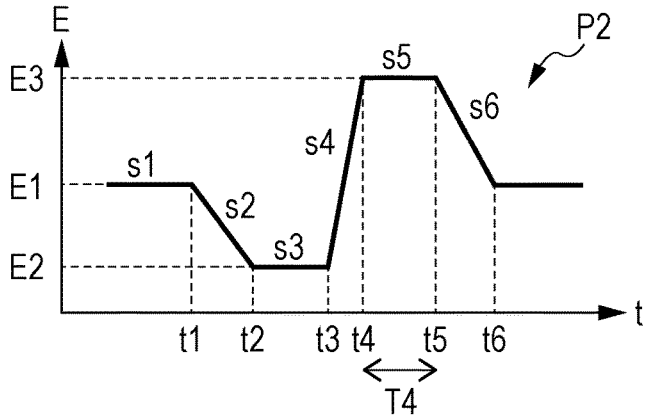
Figure 16:
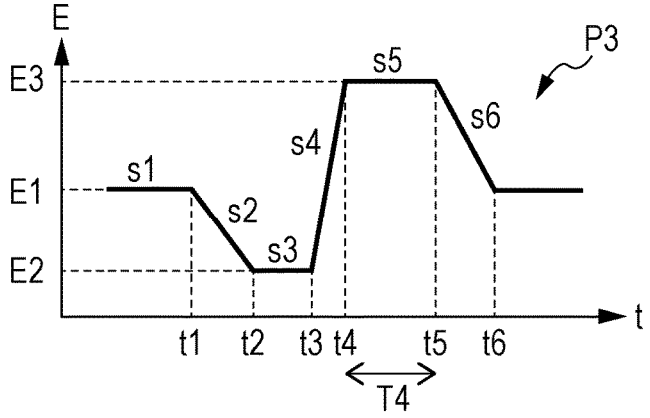

FIG. 16 schematically illustrates an example of the drive pulse determination procedure of determining the drive pulse P0 having the third potential time T4 that varies depending on the discharge angle θ when the recording condition acquisition procedure of acquiring the discharge angle θ as the recording condition 400 is performed, in a case where the third potential time T4 of the drive pulse P0 is relatively long. The drive pulse P0 illustrated in FIG. 16 has a waveform in which the third potential time T4 is changed as illustrated in FIG. 12A.

As a result of the test, a tendency that, when the third potential time T4 is relatively long, the discharge angle θ increases as the third potential time T4 becomes longer has been found. From this tendency, the followings are understood. That is, when it is desired to decrease the discharge angle of the liquid LQ actually discharged from the nozzle 13 because the discharge angle θ is large, the third potential time T4 may be set to be decreased. When the actual discharge angle is small, the third potential time T4 may be set to be increased.

In the drive pulse determination procedure, when the discharge angle θ acquired as the recording condition 400 for the target liquid discharge head is the second angle θ2, the second drive pulse P2 is determined as the drive pulse P0 to be applied to the drive element 31 such that the actual discharge angle enters into the allowable range of the target value illustrated in FIG. 6.

Regarding another target liquid discharge head, the discharge angle θ acquired as the recording condition 400 is set to the first angle θ1 which is larger than the second angle θ2, and the actual discharge angle is set to be desired to decrease. In this case, in the drive pulse determination procedure, the first drive pulse P1 having the third potential time T4 which is shorter than the third potential time of the second drive pulse P2 is determined as the drive pulse to be applied to the drive element 31. Thus, because the actual discharge angle of the target liquid discharge head is adjusted to be reduced, the difference between the actual discharge angle and the target discharge angle of the target liquid discharge head is reduced.

In the drive pulse determination procedure, a threshold value of the discharge angle θ may be set as Tθ, and the threshold value T0 may be set between the first angle θ1 and the second angle θ2. In this case, in the drive pulse determination procedure, for example, the first drive pulse P1 may be determined as the drive pulse P0 to be applied to the drive element 31 when the discharge angle θ is equal to or larger than the threshold value Tθ. The second drive pulse P2 may be determined as the drive pulse P0 to be applied to the drive element 31 when the discharge angle θ is smaller than the threshold value Tθ.

The determined drive pulse P0 is applied to the drive element 31.

From the above description, the liquid discharge method in the present specific example includes, in the driving step ST3, applying the first drive pulse P1 to the drive element 31 when the discharge angle θ acquired as the recording condition 400 is the first angle θ1, and applying the second drive pulse P2 to the drive element 31 when the discharge angle θ acquired as the recording condition 400 is the second angle θ2 smaller than the first angle θ1. Thus, in the present specific example, when the third potential time T4 is relatively long, it is possible to reduce the variation in the discharge angle of the liquid LQ actually discharged from the nozzle 13 in accordance with the discharge angle θ as the discharge characteristic.

Figure 17:
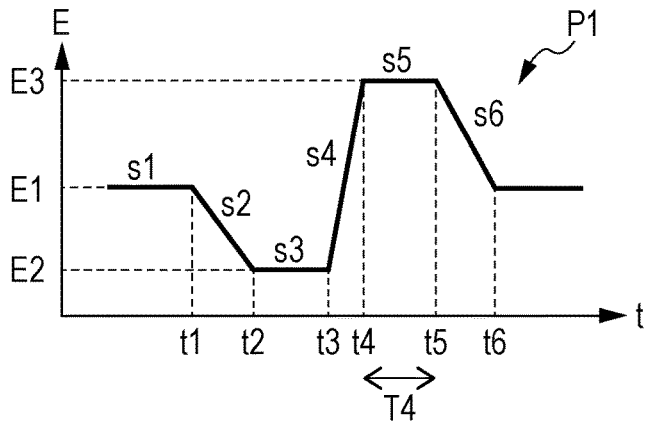
FIG. 17 is a schematic diagram illustrating still yet another example of determining the drive pulse having the third potential time that varies depending on the discharge angle of the liquid.
Figure 17:
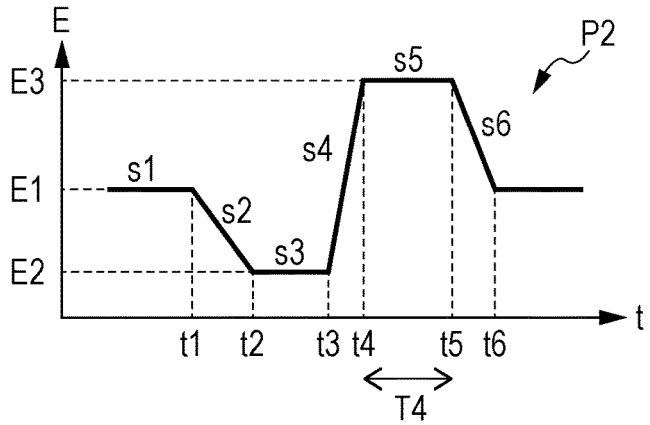
Figure 18:
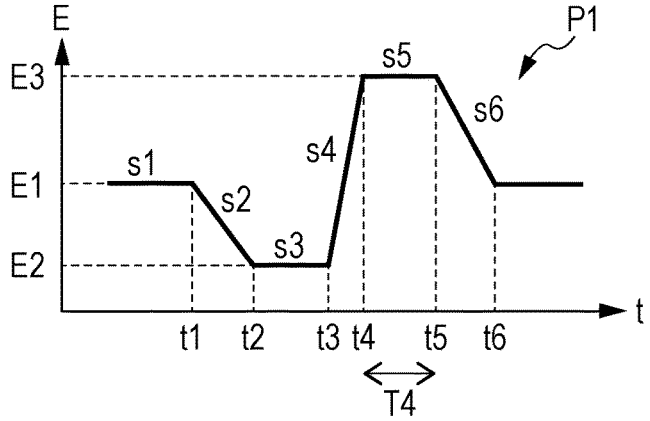
FIG. 18 is a schematic diagram illustrating still yet another example of determining the drive pulse having the third potential time that varies depending on the discharge angle of the liquid.
Figure 18:
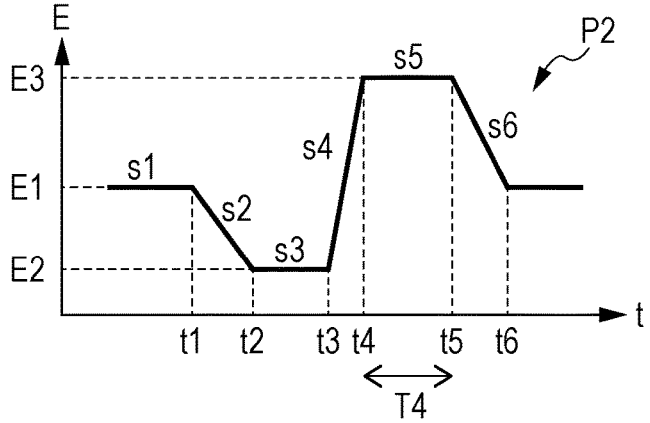

FIGS. 17 and 18 also schematically illustrate examples of the drive pulse determination procedure of determining the drive pulse P0 having the third potential time T4 that varies depending on the discharge angle θ when the recording condition acquisition procedure of acquiring the discharge angle θ as the recording condition 400 is performed, in a case where the third potential time T4 is relatively long. The drive pulse P0 illustrated in FIG. 17 has a waveform in which the third potential time T4 is changed as illustrated in FIG. 12B. The drive pulse P0 illustrated in FIG. 18 has a waveform in which the third potential time T4 is changed as illustrated in FIG. 12C. Similar to the example illustrated in FIG. 16, in the drive pulse determination procedure, when the acquired discharge angle θ is the first angle θ1, the first drive pulse P1 is determined as the drive pulse P0 to be applied to the drive element 31 such that the actual discharge angle enters into the allowable range of the target value illustrated in FIG. 6. In the drive pulse determination procedure, when the acquired discharge angle θ is the second angle θ2 which is smaller than the first angle θ1, the second drive pulse P2 is determined as the drive pulse P0 to be applied to the drive element 31 such that the actual discharge angle enters into the allowable range of the target value. The determined drive pulse P0 is applied to the drive element 31. In the specific examples illustrated in FIGS. 17 and 18, when the third potential time T4 is relatively long, it is also possible to reduce the variation in the discharge angle of the liquid LQ actually discharged from the nozzle 13 in accordance with the discharge angle θ as the discharge characteristic.

Figure 19:
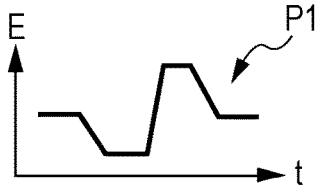
FIG. 19 is a schematic diagram illustrating still yet another example of determining the drive pulse having the third potential time that varies depending on the discharge angle of the liquid.
Figure 19:
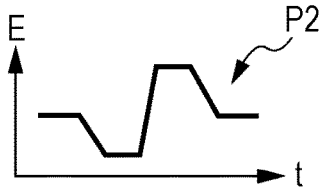
Figure 19:
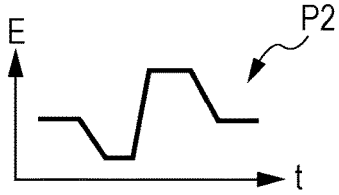
Figure 19:
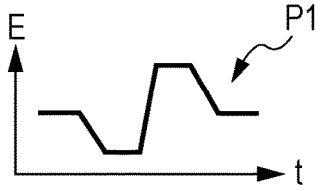

FIG. 19 schematically illustrates an example of determining the drive pulse P0 in which the third potential time T4 varies depending on whether the third potential time T4 is relatively short or relatively long in addition to the discharge angle θ. In the example illustrated in FIG. 19, the third potential time T4 which is relatively short is set to be referred to as a first time TT1, and the third potential time T4 which is relatively long is set to be referred to as a second time TT2.

In the drive pulse determination procedure, when the third potential time T4 of a plurality of drive pulses P0 of which any is intended to be applied is relatively short, the drive pulse P0 is determined in a manner as illustrated in FIG. 13. The plurality of drive pulses P0 include the first drive pulse P1 and the second drive pulse P2. The third potential time T4 of the second drive pulse P2 is longer than the third potential time of the first drive pulse P1. Thus, when the third potential time T4 of the second drive pulse P2 is the first time TT1 which is relatively short, the drive pulse P0 is determined in the manner as illustrated in FIG. 13. T4(P2) illustrated in FIG. 19 indicates the third potential time T4 of the second drive pulse P2. For example, in the drive pulse determination procedure, when the discharge angle θ in the target liquid discharge head is the first angle θ1, the first drive pulse P1 is determined as the drive pulse P0 to be applied to the drive element 31 such that the actual discharge angle enters into the allowable range of the target value illustrated in FIG. 6. In the drive pulse determination procedure, when the discharge angle θ in the target liquid discharge head is the second angle θ2 which is larger than the first angle θ1, the second drive pulse P2 having the third potential time T4 which is longer than the third potential time of the first drive pulse P1 is determined as the drive pulse P0 to be applied to the drive element 31 such that the actual discharge angle enters into the allowable range of the target value. Thus, the difference between the actual discharge angle and the target discharge angle in the target liquid discharge head is reduced.

In the drive pulse determination procedure, when the third potential time T4 of the plurality of drive pulses P0 of which any is intended to be applied to another liquid discharge head is relatively long, the drive pulse P0 is determined such that the length relation of the third potential time T4 is opposite to the above-described case. The third potential time T4 of the first drive pulse P1 is shorter than the third potential time of the second drive pulse P2. Thus, when the third potential time T4 of the first drive pulse P1 is the second time TT2 which is relatively long, the drive pulse P0 is determined such that the length relation of the third potential time T4 is opposite to the length relation of the third potential time in the above-described case. T4(P1) illustrated in FIG. 19 indicates the third potential time T4 of the first drive pulse P1. For example, in the drive pulse determination procedure, when the discharge angle θ in the target liquid discharge head is the first angle θ1, the second drive pulse P2 is determined as the drive pulse P0 to be applied to the drive element 31 such that the actual discharge angle enters into the allowable range of the target value illustrated in FIG. 6. In the drive pulse determination procedure, when the discharge angle θ in the target liquid discharge head is the second angle θ2 which is larger than the first angle θ1, the first drive pulse P1 having the third potential time T4 which is shorter than the third potential time of the second drive pulse P2 is determined as the drive pulse P0 to be applied to the drive element 31 such that the actual discharge angle enters into the allowable range of the target value. Thus, the difference between the actual discharge angle and the target discharge angle in the target liquid discharge head is reduced.

In the drive pulse determination procedure, a threshold value of the third potential time T4 may be set to THT4, and the threshold value THT4 may be set between the first time TT1 and the second time TT2. In this case, in the drive pulse determination procedure, for example, when the third potential time T4(P2) of the second drive pulse P2 is shorter than the threshold value THT4, the drive pulse P0 may be determined as illustrated in FIG. 13. When the third potential time T4(P1) of the first drive pulse P1 is equal to or longer than the threshold value THT4, the drive pulse P0 may be determined such that the length relation of the third potential time T4 is opposite to the above description.

In the drive pulse determination procedure, the threshold value T0 may be set between the first angle θ1 and the second angle θ2. In this case, in the drive pulse determination procedure, the drive pulse P0 may be determined as follows, for example.

a. When the third potential time T4(P2) is shorter than the threshold value THT4 and the discharge angle θ is smaller than the threshold value Tθ, the first drive pulse P1 is determined as the drive pulse P0 to be applied to the drive element 31. b. When the third potential time T4(P2) is shorter than the threshold value THT4 and the discharge angle θ is equal to or larger than the threshold value Tθ, the second drive pulse P2 is determined as the drive pulse P0 to be applied to the drive element 31. c. When the third potential time T4(P1) is equal to or longer than the threshold value THT4 and the discharge angle θ is smaller than the threshold value Tθ, the second drive pulse P2 is determined as the drive pulse P0 to be applied to the drive element 31. d. When the third potential time T4(P1) is equal to or longer than the threshold value THT4 and the discharge angle θ is equal to or larger than the threshold value Tθ, the first drive pulse P1 is determined as the drive pulse P0 to be applied to the drive element 31.

The determined drive pulse P0 is applied to the drive element 31.

From the above description, the liquid discharge method in the present specific example includes the following in the driving step ST3.

A. When the time T4 of the third potential E3 included in the second drive pulse P2 is the first time TT1 and the discharge angle θ acquired in the acquisition step ST1 is the first angle θ1, the first drive pulse P1 is applied to the drive element 31.

B. When the time T4 of the third potential E3 included in the second drive pulse P2 is the first time TT1 and the discharge angle θ acquired in the acquisition step ST1 is the second angle θ2 which is larger than the first angle θ1, the second drive pulse P2 is applied to the drive element 31.

C. When the time T4 of the third potential E3 included in the first drive pulse P1 is the second time TT2 longer than the first time TT1, and the discharge angle θ acquired in the acquisition step ST1 is the first angle θ1, the second drive pulse P2 is applied to the drive element 31.

D. When the time T4 of the third potential E3 included in the first drive pulse P1 is the second time TT2 and the discharge angle θ acquired in the acquisition step ST1 is the second angle θ2, the first drive pulse P1 is applied to the drive element 31.

When the third potential time T4 of the drive pulse P0 is relatively short, the discharge angle θ tends to decrease as the third potential time T4 becomes longer. Here, in the target liquid discharge head, when the discharge angle θ acquired as the recording condition 400 is the first angle θ1 which is relatively small, the first drive pulse P1 having the third potential time T4 which is relatively short is applied to the drive element 31. In the target liquid discharge head, when the discharge angle θ acquired as the recording condition 400 is the second angle θ2 which is relatively large, the second drive pulse P2 having the third potential time T4 which is relatively long is applied to the drive element 31 such that the actual discharge angle is decreased. Thus, the difference between the actual discharge angle and the target discharge angle in the target liquid discharge head when the third potential time T4 is relatively short is reduced.

When the third potential time T4 of the drive pulse P0 is relatively long, the discharge angle θ tends to decrease as the third potential time T4 becomes shorter. Here, in the target liquid discharge head, when the discharge angle θ acquired as the recording condition 400 is the first angle θ1 which is relatively small, the second drive pulse P2 having the third potential time T4 which is relatively long is applied to the drive element 31. In the target liquid discharge head, when the discharge angle θ acquired as the recording condition 400 is the second angle θ2 which is relatively large, the first drive pulse P1 having the third potential time T4 which is relatively short is applied to the drive element 31 such that the actual discharge angle is decreased. Thus, when the third potential time T4 is relatively long, the difference between the actual discharge angle and the target discharge angle in the target liquid discharge head is reduced.

As described above, in the present specific example, it is possible to reduce the variation in the discharge angle of the liquid LQ actually discharged from the nozzle 13 in accordance with the discharge angle θ as the discharge characteristic, and the third potential time T4 of the drive pulse P0.

Figure 20:
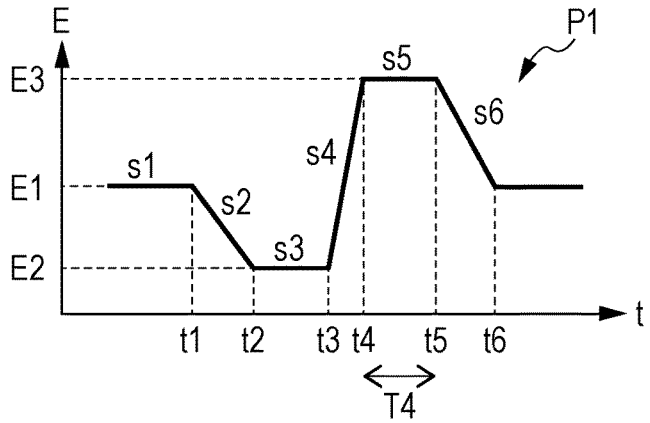
FIG. 20 is a schematic diagram illustrating an example of determining the drive pulse having the third potential time that varies depending on an aspect ratio.
Figure 20:
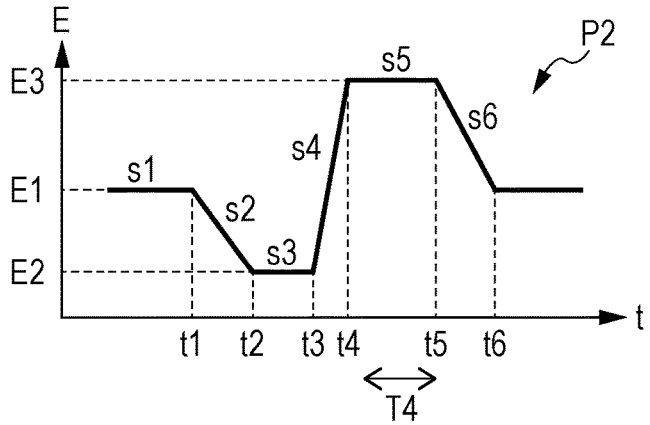
Figure 21:
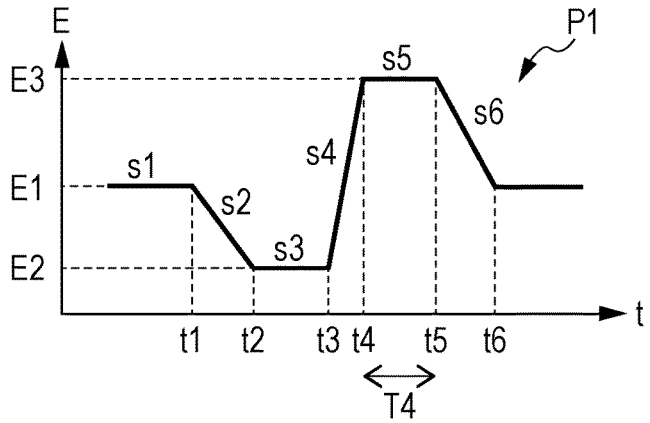
FIG. 21 is a schematic diagram illustrating another example of determining the drive pulse having the third potential time that varies depending on the aspect ratio.
Figure 21:
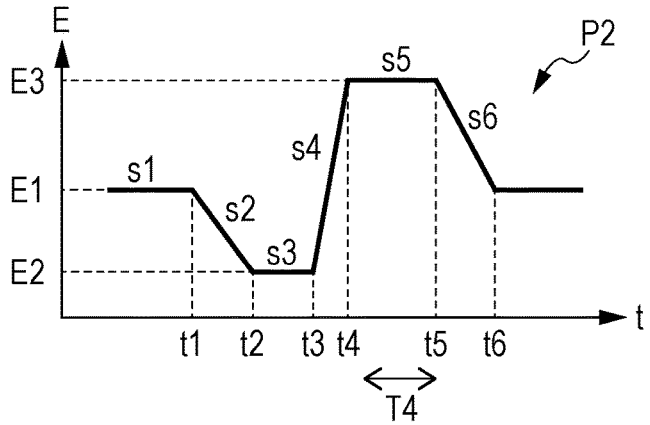
Figure 22:
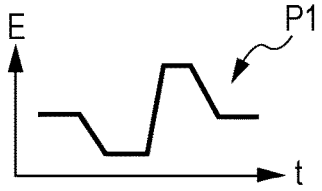
FIG. 22 is a schematic diagram illustrating still another example of determining the drive pulse having the third potential time that varies depending on the aspect ratio.
Figure 22:
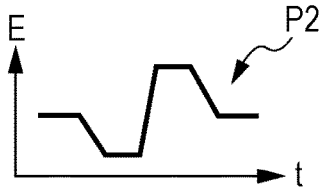
Figure 22:
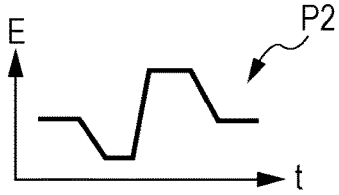
Figure 22:
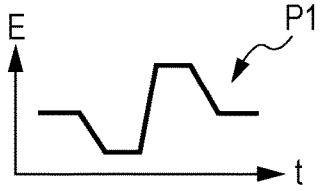

FIGS. 20 to 22 schematically illustrate examples of the drive pulse determination procedure of determining the drive pulse P0 having the third potential time T4 that varies depending on the aspect ratio AR when the recording condition acquisition procedure of acquiring the aspect ratio AR as the recording condition 400 is performed. The aspect ratio AR is an index value representing the shape of the liquid LQ discharged from the nozzle 13 when the drive pulse for acquiring the recording condition is applied to the drive element 31, as illustrated in FIGS. 8A and 8B.

Firstly, the relation between the aspect ratio AR and the third potential time T4 when the third potential time T4 of the drive pulse P0 is relatively short will be described. In the following various examples, descriptions will be made on the assumption that the drive pulse P0 has a waveform in which the third potential time T4 is changed as illustrated in FIG. 12A. Various waveforms including the examples illustrated in FIGS. 12B and 12C may be applied to the drive pulse P0. As a result of the test, a tendency that, when the third potential time T4 is relatively short, the aspect ratio AR decreases as the third potential time T4 becomes longer has been found. From this tendency, the followings are understood. That is, when it is desired to decrease the aspect ratio of the liquid LQ actually discharged from the nozzle 13 because the aspect ratio AR is large, the third potential time T4 may be set to be increased. When the actual aspect ratio is small, the third potential time T4 may be set to be decreased.

In the example illustrated in FIG. 20, the drive pulse P0 adjusted when the aspect ratio AR acquired as the recording condition 400 for the target liquid discharge head is a first aspect ratio AR1 is set to be referred to as the first drive pulse P1. The drive pulse P0 having the third potential time T4 which is longer than the third potential time of the first drive pulse P1 is set to be referred to as the second drive pulse P2.

In the drive pulse determination procedure, when the acquired aspect ratio AR is the first aspect ratio AR1, the first drive pulse P1 is determined as the drive pulse P0 to be applied to the drive element 31 such that the actual aspect ratio enters into the allowable range of the target value.

Regarding another target liquid discharge head, the aspect ratio AR acquired as the recording condition 400 is set to the second aspect ratio AR2 greater than the first aspect ratio AR1, and the actual aspect ratio is set to be desired to decrease to enter into the allowable range of the target value. In this case, in the drive pulse determination procedure, the second drive pulse P2 having the third potential time T4 which is longer than the third potential time of the first drive pulse P1 is determined as the drive pulse to be applied to the drive element 31. Thus, because the actual aspect ratio of the target liquid discharge head is adjusted to be reduced, the difference between the actual aspect ratio and the target aspect ratio of the target liquid discharge head is reduced.

In the drive pulse determination procedure, a threshold value of the aspect ratio AR may be set as TAR, and the threshold value TAR may be set between the first aspect ratio AR1 and the second aspect ratio AR2. In this case, in the drive pulse determination procedure, for example, the first drive pulse P1 may be determined as the drive pulse P0 to be applied to the drive element 31 when the aspect ratio AR is equal to or smaller than the threshold value TAR. The second drive pulse P2 may be determined as the drive pulse P0 to be applied to the drive element 31 when the aspect ratio AR is equal to or greater than the threshold value TAR.

The waveform information 60 representing the determined drive pulse P0 is stored, for example, in the memory 43 illustrated in FIG. 1 and is used when the drive signal generation circuit 45 generates the drive signal COM. The drive pulse P0 in the drive signal COM is applied to the drive element 31.

From the above description, the liquid discharge method in the present specific example includes, in the driving step ST3, applying the first drive pulse P1 to the drive element 31 when the aspect ratio AR acquired as the recording condition 400 is the first aspect ratio AR1, and applying the second drive pulse P2 to the drive element 31 when the aspect ratio AR acquired as the recording condition 400 is the second aspect ratio AR2 greater than the first aspect ratio AR1. Thus, in the present specific example, it is possible to reduce the variation in the aspect ratio of the liquid LQ actually discharged from the nozzle 13 in accordance with the aspect ratio AR as the discharge characteristic.

FIG. 21 schematically illustrates an example of the drive pulse determination procedure of determining the drive pulse P0 having the third potential time T4 that varies depending on the aspect ratio AR when the recording condition acquisition procedure of acquiring the aspect ratio AR as the recording condition 400 is performed in a case where the third potential time T4 of the drive pulse P0 is relatively long.

As a result of the test, a tendency that, when the third potential time T4 is relatively long, the aspect ratio AR increases as the third potential time T4 becomes longer has been found. From this tendency, the followings are understood. That is, when it is desired to decrease the aspect ratio of the liquid LQ actually discharged from the nozzle 13 because the aspect ratio AR is large, the third potential time T4 may be set to be decreased. When the actual aspect ratio is small, the third potential time T4 may be set to be increased.

In the example illustrated in FIG. 21, the drive pulse P0 adjusted when the aspect ratio AR acquired as the recording condition 400 for the target liquid discharge head is the second aspect ratio AR2 is set to be referred to as the second drive pulse P2. The drive pulse P0 having the third potential time T4 which is shorter than the third potential time of the second drive pulse P2 is set to be referred to as the first drive pulse P1.

In the drive pulse determination procedure, when the acquired aspect ratio AR is the second aspect ratio AR2, the second drive pulse P2 is determined as the drive pulse P0 to be applied to the drive element 31 such that the actual aspect ratio enters into the allowable range of the target value.

Regarding another target liquid discharge head, the aspect ratio AR acquired as the recording condition 400 is set to a first aspect ratio AR1 greater than the second aspect ratio AR2, and the actual aspect ratio is set to be desired to decrease to enter into the allowable range of the target value. In this case, in the drive pulse determination procedure, the first drive pulse P1 having the third potential time T4 which is shorter than the third potential time of the second drive pulse P2 is determined as the drive pulse to be applied to the drive element 31. Thus, because the actual aspect ratio of the target liquid discharge head is adjusted to be reduced, the difference between the actual aspect ratio and the target aspect ratio of the target liquid discharge head is reduced.

In the drive pulse determination procedure, a threshold value of the aspect ratio AR may be set as TAR, and the threshold value TAR may be set between the first aspect ratio AR1 and the second aspect ratio AR2. In this case, in the drive pulse determination procedure, for example, the first drive pulse P1 may be determined as the drive pulse P0 to be applied to the drive element 31 when the aspect ratio AR is equal to or greater than the threshold value TAR. The second drive pulse P2 may be determined as the drive pulse P0 to be applied to the drive element 31 when the aspect ratio AR is smaller than the threshold value TAR.

The waveform information 60 representing the determined drive pulse P0 is stored, for example, in the memory 43 illustrated in FIG. 1 and is used when the drive signal generation circuit 45 generates the drive signal COM. The drive pulse P0 in the drive signal COM is applied to the drive element 31.

From the above description, the liquid discharge method in the present specific example includes, in the driving step ST3, applying the first drive pulse P1 to the drive element 31 when the aspect ratio AR acquired as the recording condition 400 is the first aspect ratio AR1, and applying the second drive pulse P2 to the drive element 31 when the aspect ratio AR acquired as the recording condition 400 is the second aspect ratio AR2 smaller than the first aspect ratio AR1. Thus, in the present specific example, when the third potential time T4 is relatively long, it is possible to reduce the variation in the aspect ratio of the liquid LQ actually discharged from the nozzle 13 in accordance with the aspect ratio AR as the discharge characteristic.

FIG. 22 schematically illustrates an example of determining the drive pulse P0 in which the third potential time T4 varies depending on whether the third potential time T4 is relatively short or relatively long in addition to the aspect ratio AR. In the example illustrated in FIG. 22, the third potential time T4 which is relatively short is set to be referred to as a first time TT1, and the third potential time T4 which is relatively long is set to be referred to as a second time TT2.

In the drive pulse determination procedure, when the third potential time T4 of a plurality of drive pulses P0 of which any is intended to be applied is relatively short, the drive pulse P0 is determined in a manner as illustrated in FIG. 20. The plurality of drive pulses P0 include the first drive pulse P1 and the second drive pulse P2. The third potential time T4 of the second drive pulse P2 is longer than the third potential time of the first drive pulse P1. Thus, when the third potential time T4 of the second drive pulse P2 is the first time TT1 which is relatively short, the drive pulse P0 is determined in the manner as illustrated in FIG. 20. T4(P2) illustrated in FIG. 22 indicates the third potential time T4 of the second drive pulse P2. For example, in the drive pulse determination procedure, when the aspect ratio AR in the target liquid discharge head is the first aspect ratio AR1, the first drive pulse P1 is determined as the drive pulse P0 to be applied to the drive element 31 such that the actual aspect ratio enters into the allowable range of the target value. In the drive pulse determination procedure, when the aspect ratio AR in the target liquid discharge head is the second aspect ratio AR2 which is greater than the first aspect ratio AR1, the second drive pulse P2 having the third potential time T4 which is longer than the third potential time of the first drive pulse P1 is determined as the drive pulse P0 to be applied to the drive element 31, such that the actual aspect ratio AR enters into the allowable range of the target value. Thus, the difference between the actual aspect ratio and the target aspect ratio in the target liquid discharge head is reduced.

In the drive pulse determination procedure, when the third potential time T4 of the plurality of drive pulses P0 of which any is intended to be applied to another liquid discharge head is relatively long, the drive pulse P0 is determined such that the length relation of the third potential time T4 is opposite to the above-described case. The third potential time T4 of the first drive pulse P1 is shorter than the third potential time of the second drive pulse P2. Thus, when the third potential time T4 of the first drive pulse P1 is the second time TT2 which is relatively long, the drive pulse P0 is determined such that the length relation of the third potential time T4 is opposite to the length relation of the third potential time in the above-described case. T4(P1) illustrated in FIG. 22 indicates the third potential time T4 of the first drive pulse P1. For example, in the drive pulse determination procedure, when the aspect ratio AR in the target liquid discharge head is the first aspect ratio AR1, the second drive pulse P2 is determined as the drive pulse P0 to be applied to the drive element 31 such that the actual aspect ratio enters into the allowable range of the target value. In the drive pulse determination procedure, when the aspect ratio AR in the target liquid discharge head is the second aspect ratio AR2 which is greater than the first aspect ratio AR1, the first drive pulse P1 having the third potential time T4 which is shorter than the third potential time of the second drive pulse P2 is determined as the drive pulse P0 to be applied to the drive element 31 such that the actual aspect ratio AR enters into the allowable range of the target value. Thus, the difference between the actual aspect ratio and the target aspect ratio in the target liquid discharge head is reduced.

In the drive pulse determination procedure, a threshold value of the third potential time T4 may be set to THT4, and the threshold value THT4 may be set between the first time TT1 and the second time TT2. In this case, in the drive pulse determination procedure, for example, when the third potential time T4(P2) of the second drive pulse P2 is shorter than the threshold value THT4, the drive pulse P0 may be determined as illustrated in FIG. 20. When the third potential time T4(P1) of the first drive pulse P1 is equal to or longer than the threshold value THT4, the drive pulse P0 may be determined such that the length relation of the third potential time T4 is opposite to the above description.

In the drive pulse determination procedure, the threshold value TAR may be set between the first aspect ratio AR1 and the second aspect ratio AR2. In this case, in the drive pulse determination procedure, the drive pulse P0 may be determined as follows, for example.

a. When the third potential time T4(P2) is shorter than the threshold value THT4 and the aspect ratio AR is smaller than the threshold value TAR, the first drive pulse P1 is determined as the drive pulse P0 to be applied to the drive element 31.

b. When the third potential time T4(P2) is shorter than the threshold value THT4 and the aspect ratio AR is equal to or greater than the threshold value TAR, the second drive pulse P2 is determined as the drive pulse P0 to be applied to the drive element 31.

c. When the third potential time T4(P1) is equal to or longer than the threshold value THT4 and the aspect ratio AR is smaller than the threshold value TAR, the second drive pulse P2 is determined as the drive pulse P0 to be applied to the drive element 31.

d. When the third potential time T4(P1) is equal to or longer than the threshold value THT4 and the aspect ratio AR is equal to or greater than the threshold value TAR, the first drive pulse P1 is determined as the drive pulse P0 to be applied to the drive element 31.

The determined drive pulse P0 is applied to the drive element 31.

From the above description, the liquid discharge method in the present specific example includes the following in the driving step ST3.

A. When the time T2 of the second potential E2 included in the second drive pulse P2 is the first time TT1 and the aspect ratio AR acquired in the acquisition step ST1 is the first aspect ratio AR1, the first drive pulse P1 is applied to the drive element 31.

B. When the time T2 of the second potential E2 included in the second drive pulse P2 is the first time TT1 and the aspect ratio AR acquired in the acquisition step ST1 is the second aspect ratio AR2 which is greater than the first aspect ratio AR1, the second drive pulse P2 is applied to the drive element 31.

C. When the time T2 of the second potential E2 included in the first drive pulse P1 is the second time TT2 which is longer than the first time TT1, and the aspect ratio AR acquired in the acquisition step ST1 is the first aspect ratio AR1, the second drive pulse P2 is applied to the drive element 31.

D. When the time T2 of the second potential E2 included in the first drive pulse P1 is the second time TT2 and the aspect ratio AR acquired in the acquisition step ST1 is the second aspect ratio AR2, the first drive pulse P1 is applied to the drive element 31.

When the third potential time T4 of the drive pulse P0 is relatively short, the aspect ratio AR tends to decrease as the third potential time T4 becomes longer. Here, in the target liquid discharge head, when the aspect ratio AR acquired as the recording condition 400 is the first aspect ratio AR1 which is relatively small, the first drive pulse P1 having the third potential time T4 which is relatively long is applied to the drive element 31. In the target liquid discharge head, when the aspect ratio AR acquired as the recording condition 400 is the second aspect ratio AR2 which is relatively large, the second drive pulse P2 having the third potential time T4 which is relatively long is applied to the drive element 31 such that the actual aspect ratio is decreased. Thus, when the third potential time T4 is relatively short, the difference between the actual aspect ratio and the target aspect ratio in the target liquid discharge head is reduced.

When the third potential time T4 of the drive pulse P0 is relatively long, the aspect ratio AR tends to decrease as the third potential time T4 becomes shorter. Here, in the target liquid discharge head, when the aspect ratio AR acquired as the recording condition 400 is the first aspect ratio AR1 which is relatively small, the second drive pulse P2 having the third potential time T4 which is relatively long is applied to the drive element 31. In the target liquid discharge head, when the aspect ratio AR acquired as the recording condition 400 is the second aspect ratio AR2 which is relatively large, the first drive pulse P1 having the third potential time T4 which is relatively short is applied to the drive element 31 such that the actual aspect ratio is decreased. Thus, when the third potential time T4 is relatively long, the difference between the actual aspect ratio and the target aspect ratio in the target liquid discharge head is reduced.

As described above, in the present specific example, it is possible to reduce the variation in the aspect ratio of the liquid LQ actually discharged from the nozzle 13 in accordance with the aspect ratio AR as the discharge characteristic and the third potential time T4 of the drive pulse P0.

In the drive pulse determination procedure of S104 in FIG. 10, the drive pulse P0 may be determined based on a plurality of conditions in the recording condition 400, for example, the drive pulse P0 may be determined based on the combination of the discharge characteristic and the on-paper characteristic. Thus, when the third potential time determination procedure of S272 in FIG. 11 is performed, the third potential time T4 may be determined based on the plurality of conditions included in the recording condition 400.

(8) Actions and Effects of Specific Examples

In the above-described specific example, since the drive pulse P0 having the third potential time T4 that varies depending on the various recording conditions 400 is applied to the drive element 31, various discharge characteristics are imparted to the liquid discharge head 11 that discharges the liquid LQ. Thus, in the above-described specific examples, it is possible to provide technologies of the liquid discharge method, the drive pulse generation program, and the liquid discharge apparatus, and the like that are capable of realizing various discharge characteristics. When the various discharge characteristics are imparted to the liquid discharge head 11, various characteristics are imparted to a dot DT formed on a recording medium MD by the liquid LQ discharged from the liquid discharge head 11.

(9) Specific Example of Automatic Algorithm

Since the recording condition 400 includes various conditions, it is preferable that the computer 200 is capable of automatically determining the drive pulse P0 to be applied to the drive element 31. An example of an automatic algorithm for determining one drive pulse to be applied in the driving step ST3, from a plurality of drive pulses P0 based on the recording condition 400 will be described with reference to FIG. 23 and the subsequent drawings.

Figure 23:
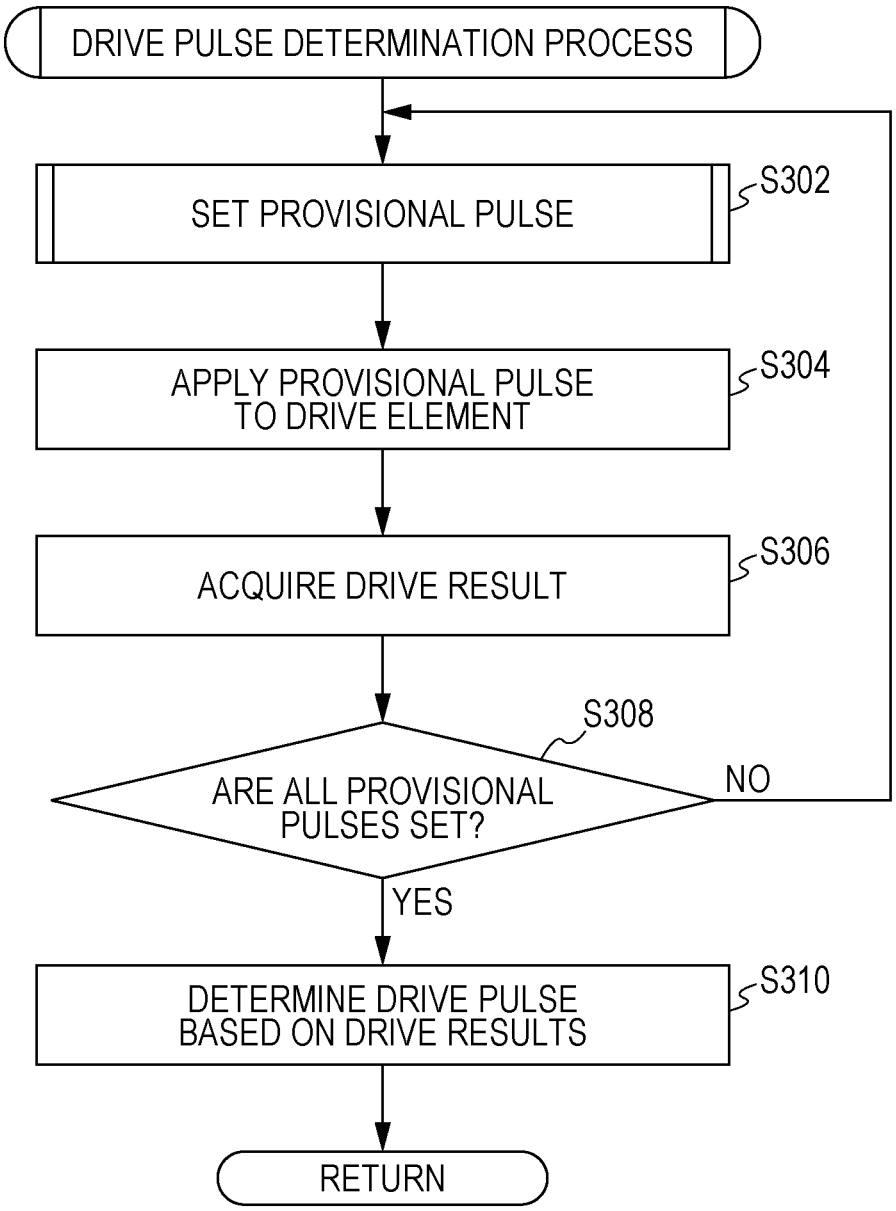
FIG. 23 is a flowchart illustrating still another example of the drive pulse determination process.

FIG. 23 illustrates an example of the drive pulse determination process performed in S104 of FIG. 10. The computer 200 that performs the example of the drive pulse determination process applies the automatic algorithm to determine one drive pulse P0 to be applied in the driving step ST3 from the plurality of drive pulses P0 based on the recording condition 400 acquired in the acquisition step ST1.

When the drive pulse determination process is started, the computer 200 sets a provisional pulse which is a drive pulse P0 to be applied to the drive element 31 on experiment (S302).

As in the example illustrated in FIG. 24, the drive pulse P0 includes a plurality of changeable factors F0. The plurality of factors F0 correspond to the times T2 and T4 illustrated in FIGS. 3, 5A, and 5B, the differences d1 and d2 of the potential E, and the change rates ΔE(s2), ΔE(s4), and ΔE(s6) of the potential E. The plurality of factors F0 illustrated in FIG. 24 include seven factors F1 to F7 as follows.

Factor F1. Difference d2, that is, |E3−E2|.

Factor F2. Difference d1, that is, |E1−E2|.

Factor F3. Change rate ΔE(s2) of the potential E, that is, |E1−E2|/T1.

Factor F4. Change rate ΔE(s4) of the potential E, that is, |E3−E2|/T3.

Factor F5. Change rate ΔE(s6) of the potential E, that is, |E3−E1|/T5.

Factor F6. Time T2 from the timing t2 to the timing t3.

Factor F7. Time T4 from the timing t4 to the timing t5.

The plurality of factors F0 may include the time T6 from the timing t6 to the timing t1 of the next drive pulse P0, and the like.

The factors F1 to F7 are associated with numerical values in a plurality of stages. For example, the factor F1 illustrated in FIG. 24 is associated with potential differences of 30 V, 35 V, 40 V, 45 V, and 50 V as the difference d2. The number of numerical steps associated with each factor F0 is not limited to five, and may be four or less, or six or more. The numerical value associated with each factor F0 is not limited to the numerical value illustrated in FIG. 24, and various numerical values are possible.

Figure 25:
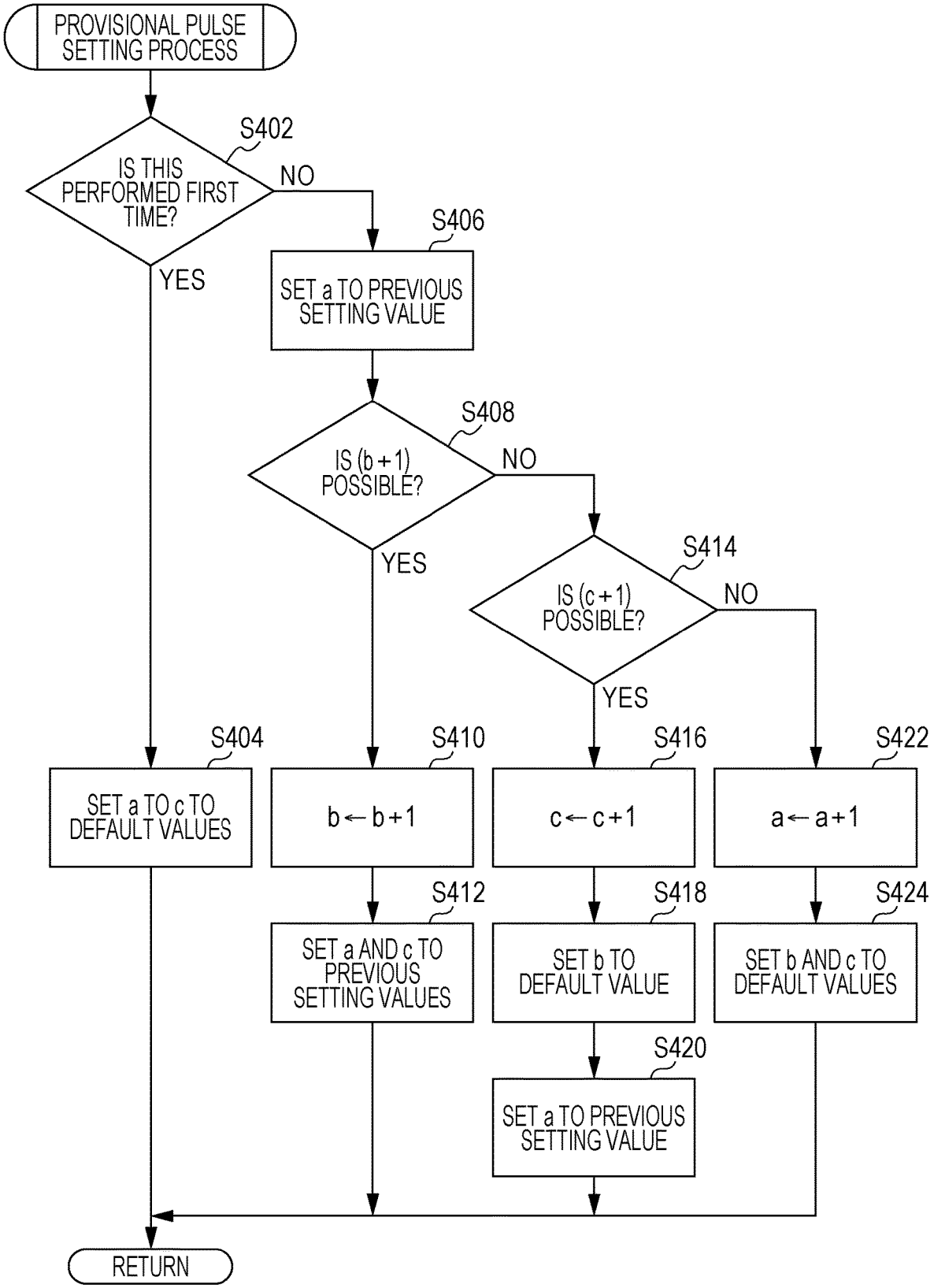
FIG. 25 is a flowchart illustrating an example of a provisional pulse setting process.

In the provisional pulse setting process of S302, a process of sequentially setting the factor F0 to be changed and sequentially changing the numerical value of the set factor F0 is performed. FIG. 25 illustrates an example of the provisional pulse setting process of implementing the above process. For convenience, the factors F1 to F7 illustrated in FIG. 24 are indicated by variables a to g. The variables a to g are freely associated one by one from the factors F1 to F7 so long as the same factor is not associated with a plurality of variables. For example, when one of the factors F1 to F7 is associated with the variable a, one of the remaining six factors is associated with the variable b, and one of the remaining five factors is associated with the variable b. Such association is repeated. As a specific example, the variable a is associated with the factor F2, the variable b is associated with the factor F6, and the variable c is associated with the factor F3, and such associated is repeated. The values of the variables a to g are integer values to be handled in the provisional pulse setting process illustrated in FIG. 25, and are integer values corresponding to the respective stages of the factor F0. For example, regarding the variable associated with the factor F1, the integer value of 1 is associated with 30 V, the integer value of 2 is associated with 35 V, the integer value of 3 is associated with 40 V, and the integer value of 4 is associated with 45 V. The integer value of 5 is associated with 50 V. In the following description, it is assumed that the factors associated with the variables a to g are simply referred to as factors a to g.

As an easy-to-understand example, FIG. 25 illustrates an example in which the default values of the variables a to c are set to 1 and the numerical values of the three factors a to c are set. When the provisional pulse setting process illustrated in FIG. 25 starts, the computer 200 branches the process depending on whether or not the provisional pulse setting process is the first process (S402). When this provisional pulse setting process is the first process, the computer 200 sets the variables a to c to the default value of 1 (S404) and ends the provisional pulse setting process. Thus, the factors a to c are set to the default values associated with the default values 1 of the variables a to c.

When the provisional pulse setting process is the second or subsequent process, the computer 200 sets the variable a to the set value set at the time of the previous provisional pulse setting process (S406). After setting the variable a, the computer 200 branches the process depending on whether or not the increase of the variable b by 1 is possible (S408). When the increase of the variable b by 1 is possible, the computer 200 increases the variable b by 1 (S410) and sets the variables a and c to the setting values set in the previous provisional pulse setting process (S412). Then, the computer ends the provisional pulse setting process. Thus, the factors a and c are set to the previous set values, and the set value of the factor b is updated.

When the increase of the variable b by 1 is not possible in S408, the computer 200 branches the process depending on whether or not the increase of the variable c by 1 is possible (S414). When the increase of the variable c by 1 is possible, the computer 200 increases the variable c by 1 (S416) and sets the variable b to the default value of 1 (S418), and sets the variable a to a setting value set in the previous provisional pulse setting process (S420). Then, the computer ends the provisional pulse setting process. As a result, the factor a is set to the previous setting value, the factor b is set to the default value, and the setting value of the factor c is updated.

When the increase of the variable c by 1 is not possible in S414, the computer 200 increases the variable a by 1 (S422) and sets the variables b and c to the default value of 1 (S424). Then, the computer ends the provisional pulse setting process. As a result, the factor a is set to the previous setting value, the factor b is set to the default value, and the setting value of the factor c is updated.

In the above-described manner, all combinations of the factors a to c in the plurality of stages included in the drive pulse P0 are set, thus and a provisional pulse is set.

Although not illustrated, with a process similar to the provisional pulse setting process illustrated in FIG. 25, all combinations of four or more factors may be set, for example, all combinations of all the factors a to c are set.

After the provisional pulse setting process of S302 in FIG. 23, the computer 200 performs a provisional pulse application control process of applying the set provisional pulse to the drive element 31 (S304). For example, the computer 200 may transmit the waveform information 60 indicating the provisional pulse determined in S302, to the apparatus 10 together with a discharge request. In this case, the apparatus 10 including the liquid discharge head 11 may perform a process of receiving the waveform information 60 together with the discharge request, a process of storing the waveform information 60 in the memory 43, and a process of applying the drive pulse P0 corresponding to the waveform information 60 to the drive element 31. As a result, the liquid LQ is discharged from the nozzle 13 with the discharge characteristics corresponding to the provisional pulse. When the discharged droplet DR lands on a recording medium MD, a dot DT is formed on the recording medium MD with the on-paper characteristic corresponding to the provisional pulse.

Then, the computer 200 acquires the drive result when the drive pulse P0 is applied to the drive element 31 (S306). The drive result corresponds to the above-mentioned recording condition 400, and includes the drive frequency f0 of the drive element 31, the discharge amount VM of the liquid LQ, the discharge rate VC of the liquid LQ, the discharge angle θ of the liquid LQ, the aspect ratio AR of the liquid LQ, the coverage CR of the dot DT, the oozing amount FT, the bleeding amount BD, and the like. The computer 200 may acquire the drive result from the detection device 300 illustrated in FIGS. 1, 7, 8A, 8B, 9A, 9B, and 9C.

After acquiring the drive result, the computer 200 branches the process depending on whether or not the provisional pulse is set for all combinations of factors (S308). When there is the provisional pulse that has not been set, the computer 200 repeats the processes of S302 to S308. Thus, for all combinations of factors, the drive result when the set provisional pulse is applied to the drive element 31 is acquired. When all the provisional pulses are set, the computer 200 determines the drive pulse P0 based on the drive result when each provisional pulse is applied to the drive element 31 such that the actual discharge characteristics and on-paper characteristics enter into the allowable ranges of the target values (S310). Then, the computer ends the drive pulse determination process. The determined drive pulse P0 is applied to the drive element 31 in the procedure of S106 in FIG. 10. The waveform information 60 indicating the waveform of the determined drive pulse P0 is stored in the storage unit such as the memory 43 in association with the identification information ID of the liquid discharge head 11, in the procedure of S110 in FIG. 10.

In FIGS. 23 to 25, for example, the computer 200 acquires the drive result when the provisional pulse obtained by fixing the factor a and gradually changing the factor b is applied to the drive element 31. Then, the computer 200 determines one drive pulse to be applied, among the plurality of provisional pulses based on the drive result, such that the actual discharge characteristics and on-paper characteristics enter into the allowable ranges of the target values. In this case, the factor a is an example of a first factor, and the factor b is an example of a second factor. Factors which may be freely selected from Factors F1 to F7 under a condition that the first factor is different from the second factor may be applied as the first factor and the second factor. Such application is the same in the following description.

From the above description, the liquid discharge method in the present specific example includes, in the determination step ST2, acquiring the drive result when the drive pulse P0 obtained by fixing the first factor and gradually changing the second factor is applied to the drive element 31, and determining one drive pulse P0 to be applied in the driving step ST3 among a plurality of drive pulses P0, based on the drive results. In the present specific example, since the drive pulse P0 is determined by the automatic algorithm, it is possible to provide technologies of the liquid discharge method, the drive pulse generation program, and the liquid discharge apparatus, and the like that are capable of easily realizing various discharge characteristics.

Since the drive pulse P0 is determined based on the drive results acquired by gradually changing the factor F7 indicating the third potential time T4, the drive pulse P0 having the third potential time T4 that varies depending on the recording condition 400 acquired in the acquisition step ST1 is applied to the drive element 31. Thus, the various discharge characteristics are imparted to the liquid discharge head 11, various discharge characteristics are realized, and various characteristics are imparted to a dot DT formed on a recording medium MD by the liquid LQ discharged from the liquid discharge head 11.

Figure 26:
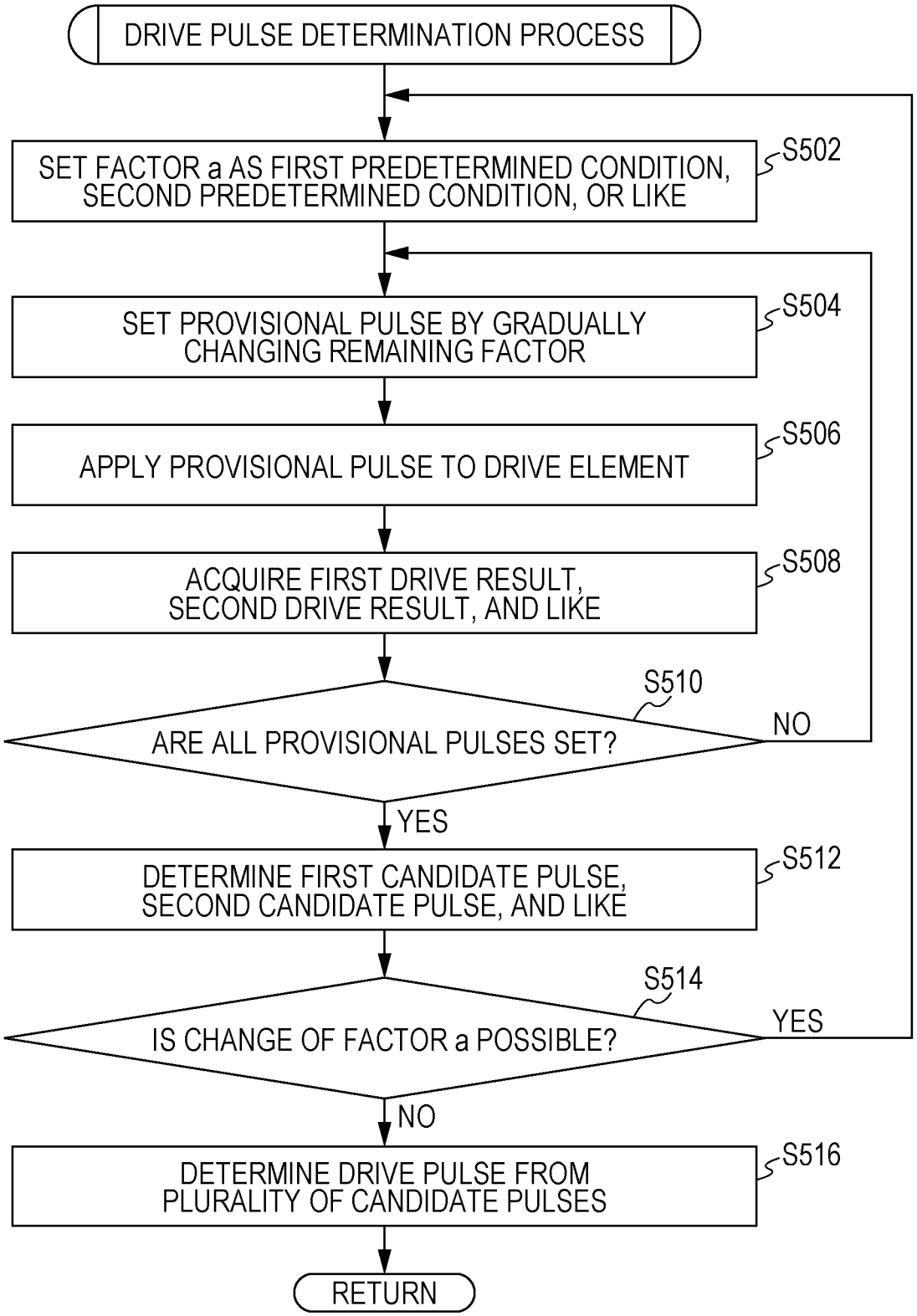
FIG. 26 is a flowchart illustrating another example of the drive pulse determination process.

The drive pulse determination process performed in S104 of FIG. 10 may be performed as illustrated in FIG. 26. When the drive pulse determination process illustrated in FIG. 26 is started, firstly, the computer 200 fixes the factor a to any setting value (S502). The process of S502 is performed a plurality of times, and the setting value of the factor a is fixed during the processes of S504 to S510 performed in each process of S502. It is assumed that the setting values that are fixed in order in S502 performed a plurality of times correspond to a first predetermined condition, a second predetermined condition, and the like. For example, when the factor a is the factor F1 illustrated in FIG. 24, 30 V is set for the process of S502 which is performed first. 35 V is set for the process of S502 which is performed secondly, and 40 V is set for the process of S502 which is performed thirdly. The process of S502 is repeated in such a manner. In this case, the factor F1 is an example of the first factor, the setting value of 30 V is an example of the first predetermined condition, and the setting value of 35 V is an example of the second predetermined condition.

When the setting value of the factor a is fixed, the computer 200 sets a provisional pulse by gradually changing the factors other than the factor a among the plurality of factors (S504). For example, when the remaining factors include the factor b, the factor a is an example of the first factor, and the factor b is an example of the second factor. The provisional pulse setting process of S504 may be set to be similar to the provisional pulse setting process illustrated in FIG. 25. After the provisional pulse setting process, the computer 200 performs a provisional pulse application control process of applying the set provisional pulse to the drive element 31 (S506). Then, the computer 200 acquires the drive result when the drive pulse P0 is applied to the drive element 31 (S508). Here, it is assumed that the drive result when the factor a is fixed as the first predetermined condition is referred to as a first drive result, the drive result when the factor a is fixed as the second predetermined condition is referred to as a second drive result, and the like. The first drive result is a drive result obtained by fixing the factor a as the first predetermined condition and gradually changing the remaining factors. The second drive result is a drive result obtained by fixing the factor a as the second predetermined condition and gradually changing the remaining factors.

The computer 200 branches the process depending on whether or not the provisional pulse is set for all combinations of factors other than the factor a (S510). When there is the provisional pulse that has not been set, the computer 200 repeats the processes of S504 to S510. Thus, for all combinations of factors other than the factor a, the drive result when the set provisional pulse is applied to the drive element 31 is acquired. When all the provisional pulses are set, the computer 200 determines candidate pulses based on the drive result when each provisional pulse is applied to the drive element 31 (S512). The candidate pulses are determined such that the actual discharge characteristics and on-paper characteristics are brought closest to the target values. Here, it is assumed that the candidate pulse determined based on the first drive result is referred to as a first candidate pulse, the candidate pulse determined based on the second drive result is referred to as a second candidate pulse, and the like. The first candidate pulse is a drive pulse that is a candidate to be applied in S106 of FIG. 10 among a plurality of drive pulses obtained by fixing the first factor as the first predetermined condition. The second candidate pulse is a drive pulse that is a candidate to be applied in S106 of FIG. 10 among a plurality of drive pulses obtained by fixing the first factor as the second predetermined condition.

The computer 200 branches the process depending on whether or not the change of the setting value of the factor a is possible (S514). When the change of the setting value of the factor a is possible, the computer 200 repeats the processes of S502 to S514. Thus, candidate pulses are determined for all setting values of the factor a. When the change of the setting value of the factor a is not possible, the computer 200 determines one drive pulse to be applied in S106 of FIG. 10 among a plurality of candidate pulses such that the actual discharge characteristics and on-paper characteristics enter into the allowable ranges of the target values (S516). Then, the computer ends the drive pulse determination process. The determined drive pulse P0 is applied to the drive element 31 in the procedure of S106 in FIG. 10. The waveform information 60 indicating the waveform of the determined drive pulse P0 is stored in the storage unit such as the memory 43 in association with the identification information ID of the liquid discharge head 11, in the procedure of S110 in FIG. 10.

From the above description, the liquid discharge method in the present specific example includes procedures 1 to 3 as follows, in the determination step ST2.

Procedure 1. Acquiring a first drive result when the drive pulse P0 is applied to the drive element 31 while the first factor is fixed as the first predetermined condition and the second factor gradually changes is acquired, and determining the first candidate pulse based on the first drive result, among the plurality of drive pulses P0 obtained by fixing the first factor as the first predetermined condition, the first candidate pulse being the drive pulse as the candidate to be applied in the driving step ST3.

Procedure 2. Acquiring the second drive result when the drive pulse P0 is applied to the drive element 31 while the first factor is fixed as the second predetermined condition different from the first predetermined condition and the second factor is gradually changed, and determining the second candidate pulse based on the second drive result, among the plurality of drive pulses P0 in which the first factor is fixed as the second predetermined condition, the second candidate pulse being the drive pulse as the candidate to be applied in the driving step ST3.

Procedure 3. Determining one drive pulse to be applied in the driving step ST3, among the plurality of candidate pulses including at least the first candidate pulse and the second candidate pulse.

In the present specific example, it is possible to provide technologies of the liquid discharge method, the drive pulse generation program, and the liquid discharge apparatus, and the like that are proper for easily realizing various discharge characteristics.

(10) Specific Example of Drive Pulse Generation System Including Server Computer The waveform information 60 representing the determined drive pulse P0 may be stored in the server computer outside the computer 200. In this case, a user of the apparatus 10 including the liquid discharge head 11 may download the waveform information 60 from the server computer to apply the drive pulse P0 represented by the waveform information 60 to the drive element 31 of the liquid discharge head 11.

Figure 27:
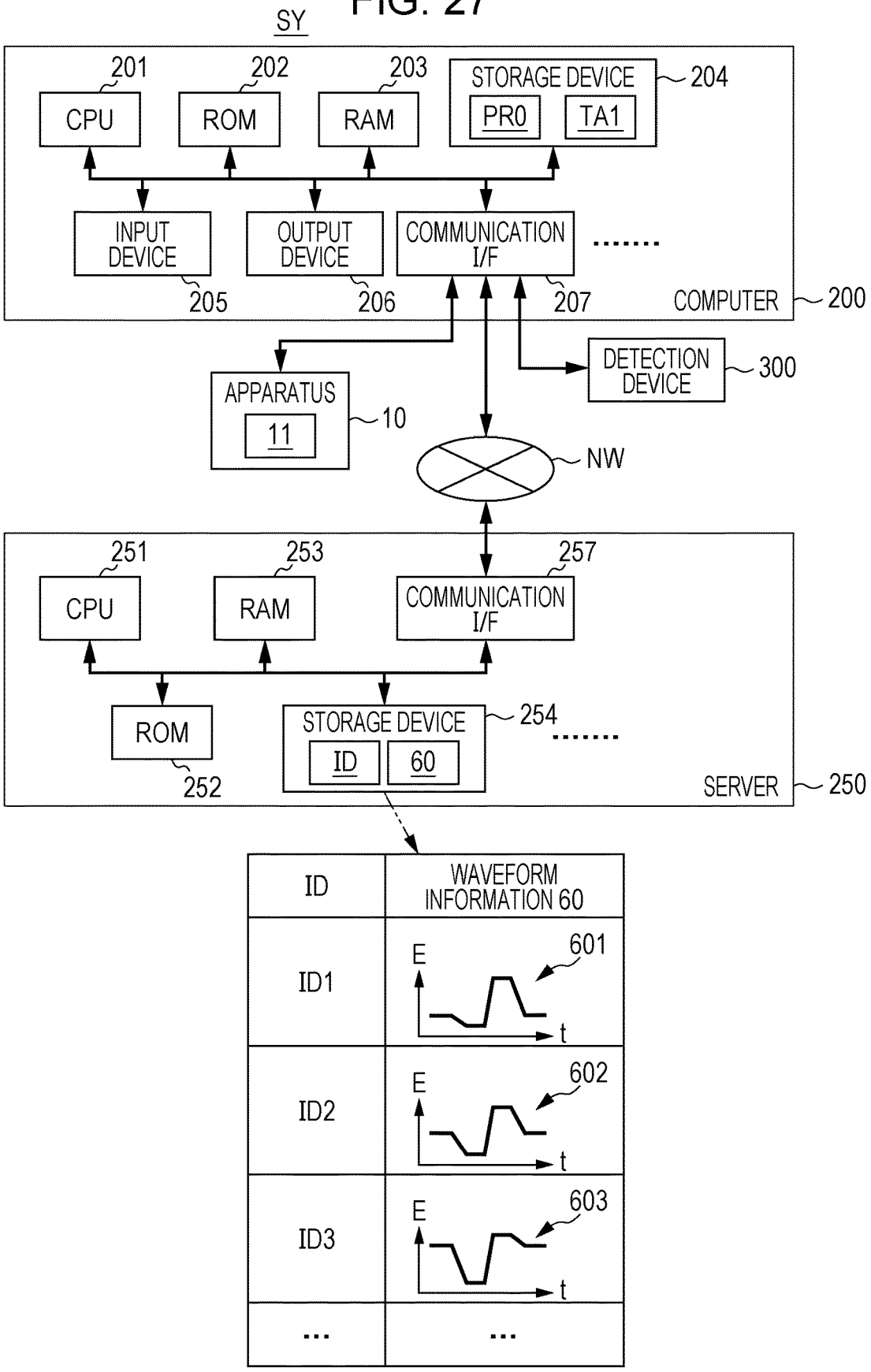
FIG. 27 is a schematic diagram illustrating the configuration example of the drive pulse generation system including a server.

FIG. 27 schematically illustrates the configuration example of the drive pulse generation system SY including the server 250. Here, the server is an abbreviation for a server computer. At the bottom of FIG. 27, an example of an information group stored in the storage device 254 is schematically illustrated.

The server 250 illustrated in FIG. 27 includes a CPU 251 being a processor, a ROM 252 being a semiconductor memory, a RAM 253 being a semiconductor memory, a storage device 254, a communication I/F 257, and the like. The elements 251 to 254, 257 and the like are electrically coupled to each other, and thus may input and output information to and from each other.

The communication I/F 257 of the server 250 and the communication I/F 207 of the computer 200 are coupled to a network NW and transmit and receive data to and from each other via the network NW. The network NW includes the Internet, a LAN, and the like. Here, the LAN is an abbreviation for a Local Area Network.

The storage device 254 stores the identification information ID of the liquid discharge head 11 and the waveform information 60 associated with the identification information ID. The storage device 254 illustrated in FIG. 27 stores waveform information 601 associated with identification information ID1, waveform information 602 associated with identification information ID2, waveform information 603 associated with identification information ID3, and the like. In the present specific example, the storage device 254 is an example of the storage unit.

In the present specific example, in the storing process of S110 in FIG. 10, the computer 200 transmits waveform information 60 representing the drive pulse P0 determined in S104 and identification information ID of the liquid discharge head 11 to which the determined drive pulse P0 is applied, to the server 250 together with a storing request. In this case, the server 250 receives the waveform information 60 and the identification information ID from the computer 200 together with the storing request, and stores the waveform information 60 in the storage device 254 in association with the identification information ID. For example, when the computer 200 transmits the waveform information 602 and the identification information ID2 to the server 250 together with the storing request, the server 250 stores the waveform information 602 in the storage device 254 in association with the identification information ID2.

As described above, when a computer enabled to be coupled to the apparatus 10 transmits a request of transmitting the waveform information 60 associated with the identification information ID, to the server 250, the server 250 transmits the waveform information 60 associated with the identification information ID, to the computer. Thus, the computer may receive the waveform information 60 associated with the identification information ID, from the server 250 and store the waveform information 60 in the memory 43 of the apparatus 10. Here, a certain computer may be the above-described computer 200 or a computer other than the computer 200.

From the above description, in the liquid discharge method of the present specific example, in the storing step ST4, the computer 200 outside the storage unit transmits the waveform information 60 associated with the identification information ID, and then stores the waveform information 60 in the storage unit, in association with the identification information ID. In the liquid discharge method of the present specific example, in the storing step ST4, the computer 200 outside the server 250 transmits the waveform information 60 associated with the identification information ID, to the server 250, and thus causes the waveform information 60 associated with the identification information ID to be stored in the storage device 254. Thus, in the present specific example, it is possible to apply the drive pulse P0 represented by the waveform information 60, to the drive element 31 by receiving the waveform information 60 associated with the identification information ID from the server 250. Accordingly, in the present specific example, it is possible to provide technologies of the liquid discharge method, the drive pulse generation program, and the liquid discharge apparatus, and the like that are convenient for easily realizing various discharge characteristics.

In the embodiment, the case where the first potential E1 is set between the second potential E2 and the third potential E3 has been described. The third potential E3 may be set between the first potential E1 and the second potential E2.

(11) Conclusion

As described above, according to various aspects of the present disclosure, it is possible to provide technologies of the liquid discharge method, the drive pulse generation program, and the liquid discharge apparatus, and the like that are capable of discharging a liquid in accordance with various recording conditions. The basic operation and effect described above may be obtained even by the technology formed only of the constituent elements according to the independent claims.

In addition, configurations obtained by replacing the components disclosed in the above-described examples with each other or by changing the combinations of the components, configurations obtained by replacing the components disclosed in the well-known technology and the above-described examples or by changing the combinations of the components may be implemented. The present disclosure also includes the above configurations and the like.

What is claimed is:

1. A liquid discharge method of using a liquid discharge head including a drive element and a nozzle to discharge a liquid from the nozzle by applying a drive pulse to the drive element, the method comprising:

an acquisition step of acquiring a recording condition; and a driving step of applying the drive pulse to the drive element, wherein the drive pulse includes a first potential, a second potential different from the first potential, and a third potential different from the first potential and the second potential, the second potential being applied after the first potential, and the third potential being applied after the second potential, and in the driving step, the drive pulse in which a time of the third potential varies depending on the recording condition acquired in the acquisition step is applied to the drive element, and in the driving step, one drive pulse determined among a plurality of the drive pulses is applied to the drive element, the drive pulses including at least a first drive pulse and a second drive pulse in which the time of the third potential is longer than the time in the first drive pulse, and in the acquisition step, an angle of a discharge direction of the liquid discharged from the nozzle with respect to a reference direction is acquired as the recording condition, and in the driving step, the first drive pulse is applied to the drive element when the angle acquired in the acquisition step is a first angle, and the second drive pulse is applied to the drive element when the angle acquired in the acquisition step is a second angle larger than the first angle.

2. The liquid discharge method according to claim 1, wherein the first potential is a potential between the second potential and the third potential.

3. The liquid discharge method according to claim 2, wherein the second potential is lower than the first potential, and the third potential is higher than the first potential.

4. The liquid discharge method according to claim 2, wherein in the driving step, one drive pulse determined among a plurality of the drive pulses is applied to the drive element, the drive pulses including at least a first drive pulse and a second drive pulse in which the time of the third potential is longer than the time of the third potential in the first drive pulse.

5. The liquid discharge method according to claim 4, wherein in the acquisition step, a discharge characteristic of the liquid from the liquid discharge head is acquired as the recording condition.

6. The liquid discharge method according to claim 4, wherein a time of the second potential in the second drive pulse is shorter than the time of the second potential in the first drive pulse.

7. The liquid discharge method according to claim 4, wherein the plurality of the drive pulses further include a third drive pulse in which the time of the third potential is longer than the time of the third potential in the second drive pulse.

8. The liquid discharge method according to claim 1, wherein in the driving step, the drive pulse in which the second potential does not vary regardless of the recording condition is applied to the drive element.

9. The liquid discharge method according to claim 1, wherein in the driving step, the drive pulse in which the first potential does not vary regardless of the recording condition is applied to the drive element.

10. A liquid discharge method of using a liquid discharge head including a drive element and a nozzle to discharge a liquid from the nozzle by applying a drive pulse to the drive element, the method comprising:

an acquisition step of acquiring a recording condition; and a driving step of applying the drive pulse to the drive element, wherein the drive pulse includes a first potential, a second potential different from the first potential, and a third potential different from the first potential and the second potential, the second potential being applied after the first potential, and the third potential being applied after the second potential, and in the driving step, the drive pulse in which a time of the third potential varies depending on the recording condition acquired in the acquisition step is applied to the drive element, and in the driving step, one drive pulse determined among a plurality of the drive pulses is applied to the drive element, the drive pulses including at least a first drive pulse and a second drive pulse in which the time of the third potential is longer than the time in the first drive pulse, and in the acquisition step, an angle of a discharge direction of the liquid discharged from the nozzle with respect to a reference direction is acquired as the recording condition, and in the driving step, the first drive pulse is applied to the drive element when the angle acquired in the acquisition step is a first angle, and the second drive pulse is applied to the drive element when the angle acquired in the acquisition step is a second angle smaller than the first angle.

11. The liquid discharge method according to claim 10, wherein the first potential is a potential between the second potential and the third potential.

12. The liquid discharge method according to claim 11, wherein the second potential is lower than the first potential, and the third potential is higher than the first potential.

13. The liquid discharge method according to claim 11, wherein in the driving step, one drive pulse determined among a plurality of the drive pulses is applied to the drive element, the drive pulses including at least a first drive pulse and a second drive pulse in which the time of the third potential is longer than the time of the third potential in the first drive pulse.

14. The liquid discharge method according to claim 13, wherein in the acquisition step, a discharge characteristic of the liquid from the liquid discharge head is acquired as the recording condition.

15. The liquid discharge method according to claim 13, wherein a time of the second potential in the second drive pulse is shorter than the time of the second potential in the first drive pulse.

16. The liquid discharge method according to claim 13, wherein the plurality of the drive pulses further include a third drive pulse in which the time of the third potential is longer than the time of the third potential in the second drive pulse.

17. The liquid discharge method according to claim 10, wherein in the driving step, the drive pulse in which the second potential does not vary regardless of the recording condition is applied to the drive element.

18. The liquid discharge method according to claim 10, wherein in the driving step, the drive pulse in which the first potential does not vary regardless of the recording condition is applied to the drive element.

* * * * *